US007866659B2

(12) United States Patent
Izumichi et al.

(10) Patent No.: US 7,866,659 B2
(45) Date of Patent: Jan. 11, 2011

(54) SHEET-FEEDING MECHANISM, SHEET-FEEDING DEVICE, AND IMAGE FORMING APPARATUS

(75) Inventors: Sachio Izumichi, Osaka (JP); Seiichi Shirasaki, Osaka (JP); Yoshihiro Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 280 days.

(21) Appl. No.: 12/166,891

(22) Filed: Jul. 2, 2008

(65) Prior Publication Data

US 2009/0014945 A1 Jan. 15, 2009

(30) Foreign Application Priority Data

Jul. 12, 2007 (JP) ..... 2007-183367
Jul. 12, 2007 (JP) ..... 2007-183548

(51) Int. Cl.
*B65H 3/52* (2006.01)
*B65H 27/00* (2006.01)

(52) U.S. Cl. ..... 271/121; 271/125

(58) Field of Classification Search ..... 271/121, 271/125; 347/104
See application file for complete search history.

(56) References Cited

U.S. PATENT DOCUMENTS 4,387,889 A * 6/1983 Koyama et al. ..... 271/10.01
4,451,027 A * 5/1984 Alper ..... 271/10.02
4,801,134 A * 1/1989 Yokoyama et al. ..... 271/122
4,974,680 A * 12/1990 Nishida et al. ..... 271/274
5,435,540 A * 7/1995 Martin et al. ..... 271/122
5,558,322 A * 9/1996 Nakatomi ..... 271/209
6,059,280 A * 5/2000 Yamauchi et al. ..... 271/109
6,099,179 A * 8/2000 Higashi et al. ..... 400/613
RE38,212 E * 8/2003 Westcott et al. ..... 271/10.03
6,942,210 B2 * 9/2005 Kawasumi ..... 271/125
2006/0103709 A1 * 5/2006 Burdenko et al. ..... 347/104
2009/0212494 A1 * 8/2009 Maeyama ..... 271/272

FOREIGN PATENT DOCUMENTS

JP 58167337 A * 10/1983
JP 11-59937 3/1999
JP 2000302305 A * 10/2000
JP 2002114421 A * 4/2002
JP 2003341630 A * 12/2003
JP 2009280355 A * 12/2009

* cited by examiner

*Primary Examiner*—Stefanos Karmis
*Assistant Examiner*—Howard Sanders
(74) *Attorney, Agent, or Firm*—George E. Hespos; Michael J. Porco

(57) ABSTRACT

An object of the present invention is to improve separability with respect to other sheet without damaging sheets in a sheet-feeding mechanism used in an image forming apparatus. For the purpose of accomplishing the object, the sheet-feeding mechanism includes: a feeding roller (10) which rotates in a sheet-conveying direction, at least a contact member (12) is made of material having elasticity; and a retard roller (20) having a plurality of press-contact rollers (21) which comes in contact with the feeding roller (10) at a predetermined pressure to form a plurality of press-contact surfaces (311), and a hardness of the contact member (12) of the feeding roller (10) is different from that of the press-contact roller (21) of the retard roller (20).

10 Claims, 24 Drawing Sheets

SHEET-FEEDING MECHANISM, SHEET-FEEDING DEVICE, AND IMAGE FORMING APPARATUS

BACKGROUND OF THE INVENTION

1. Filed of the Invention

The present invention relates to a sheet-feeding mechanism used in image forming apparatuses such as a copying machine, a printer, and a facsimile machine. The present invention relates also to a sheet-feeding device and an image forming apparatus provided with the sheet-feeding mechanism.

2. Description of the Related Art

In conventional image forming apparatuses such as a copying machine and a printer, a sheet-feeding device is provided for feeding sheets which are subjected to image forming. FIG. 17 schematically shows a configuration of such image forming apparatus.

As shown in FIG. 17, an image forming apparatus 100 includes an image forming section 130 and an image fixing section 140. The image forming section 130 is adapted to create an image in a form of a toner image and causes the toner image to be formed on a sheet which is fed from a manual feeding tray 110 or a sheet-feeding device 120. The image fixing section 140 fixes the toner image formed on the sheet to provide a printed object.

Further, under the image forming section 130, there are provided a plurality of sheet-feeding devices 120 in a stacked state.

Each sheet-feeding device 120 includes a tray 125 for holding sheets, and a sheet-feeding mechanism 200, which is indicated by surrounding dotted lines in FIG. 17, for guiding the sheets from the tray 125 to the image forming section 130. The sheets conveyed from the tray 125 and the sheet-feeding mechanism 200 are conveyed to the image forming section 130 through a common conveying passage.

Next, FIG. 18 is a side view schematically showing relevant parts of the sheet-feeding device 120. As shown in FIG. 18, in the sheet-feeding device 120, the tray 125 is fixed to a housing bottom surface 126 of the sheet-feeding device 120 rotatably through a rotating mechanism 127, and held in a state of inclining at a predetermined angle.

Further, the pick-up roller 211 is accommodated in a housing 210, which is made of resin, together with a feeding roller 212 which will be described herebelow. The housing 210 is mounted on a housing upper surface, which is not illustrated, of the sheet-feeding device 120 through an elastic member 213, and rotated about a rotational axis of the feeding roller 212 downward in the drawing by a pressure exerted by the elastic member 213. This causes the pick-up roller 211 to come in contact with a surface of sheets held on the inclining tray 125. FIG. 18 shows a state where the sheets are not placed on the tray 125, and the surface of the tray 125 is in contact with the pick-up roller 211 directly.

Next, the retard roller 215 is provided on a side of the housing of the sheet-feeding device 120 so as to face the feeding roller 212 provided in the housing 210. The elastic member 217 exerts a biasing force to cause the retard roller 215 to move toward the surface of the feeding roller 212, so that the retard roller 215 is pressed against the feeding roller 212 at a predetermined nip pressure.

The feeding roller 212 is a roller which is constantly rotated by an unillustrated external drive source and causes the pick-up roller 211 to be rotated in a rotational direction which is the same as the rotational direction of the feeding roller 212, through an intermediate gear 214.

Further, the retard roller 215 normally rotates in the opposite direction with respect to the rotational direction of the feeding roller 212, and it rotates in a forward direction in accordance with a load exerted to an unillustrated torque limiter. Further, before a nip portion N formed by the feeding roller 212 and the retard roller 215, a part of a housing wall surface of the sheet-feeding device 120 is provided as a cover 216.

FIG. 19 is a perspective view schematically showing a configuration near the retard roller 215 of the sheet-feeding device 120. Further, FIG. 20 is a perspective view schematically showing a positional relationship between the feeding roller 212 and the retard roller 215 in the sheet-feeding device 120.

As shown in FIG. 20, the cover 216 serves as a guide plate for guiding a sheet conveyed from the tray 125 to a position between the feeding roller 212 and the retard roller 215 along with a plurality of fins 220 provided at predetermined intervals on opposite sides of the retard roller 215. As shown in FIG. 18, the sheet is guided along the cover 216 to the nip portion N formed between the feeding roller 212 and the retard roller 215, and then is conveyed to the image forming section 130.

The feeding roller 212 and the retard roller 215 are mechanisms for preventing multi-feeding of the sheets. In other words, as shown in FIG. 21, the sheet sent out by the pick-up roller 211 to the feeding roller 212 is not necessarily one sheet at each time. There is a case where a plurality of sheets are sent out at one time in a stacked state due to a friction between surfaces of the sheets.

For example, when two stacked sheets 300*a* and 300*b* are conveyed to the nip portion N formed between the feeding roller 212 and the retard roller 215, the upper sheet 300*a* comes in contact with the surface of the feeding roller 212 rotating in a conveying direction and is sent to inside. On the other hand, rotation of the retard roller 215 in the opposite direction with respect to the rotational direction of the feeding roller 212 pushes back the lower sheet 300*b* toward the opposite direction with respect to the conveying direction of the sheet 300*a* indicated by an arrow in FIG. 21.

When only the sheet 300*a* is fed by the pick-up roller 211, the feeding roller 212 and the retard roller 215 exert a force to the sheet in opposite directions. However, when a load which is greater than a predetermined amount of load is applied to the torque limiter, the retard roller 215 is rotated in the opposite direction, in other words, a direction of following the rotational direction of the feeding roller 212. Thus, the sheet 300*a* is sent toward the conveying direction of the arrow shown in FIG. 21 by respective rotations of the feeding roller 212 and the retard roller 215.

In the operation of the sheet-feeding mechanism 200, it is required that the feeding roller 212 assuredly separates the upper sheet 300*a* and the sheet 300*b*. In such technology as disclosed in Japanese Patent Unexamined Publication H11-59937 (hereinafter, referred to as "patent document 1"), as shown in FIG. 22A and FIG. 22B which is a sectional view taken along the A-A line of FIG. 22A, there is a form in which a pair of belts 400 are used in place of a feeding roller. This form is so configured that a retard roller 450, which has a projecting portion 452 having an outer diameter larger than that of a main body 451, is provided at a position corresponding to a mid portion of the belt 400, and the projecting portion 452 of the retard roller 450 fits into a clearance between the pair of belts 400 to form a nip portion N.

In the retard roller 450, fine irregularity is formed on the surface of the projecting portion 452 so that the friction coefficient of the surface of the projecting portion 452 is greater than that of the surface of the main body 451.

According to such configuration, the sheet to be conveyed is sandwiched between the belts 400 and the main body 451 of the retard roller 450, and the sheet to be pushed back comes in contact with the projecting portion 452 at the clearance between the belts 400, so that separability to separate the sheet to be conveyed to the image forming section 130 from other sheet is improved.

However, in the conventional sheet-feeding mechanism shown in FIGS. 22A and 22B, the following problem is present. In particular, since the projecting portion 452 of the retard roller 450 has an outer circumference which is larger than other parts, as schematically shown in FIG. 23, an end portion of the sheet, which is to be conveyed to the nip portion N in the conveying direction indicated by the broken line in FIG. 23, certainly comes in contact with the projecting portion 452 firstly regardless of the number or kind of the sheet.

The projecting portion 452 as a part of the retard roller 450 is rotated in the opposite direction with respect to the conveying direction of the sheet, and the surface is in a rough state having irregularity. Therefore, it was likely that, when the sheet to be conveyed collides with the projecting portion 452, the end portion and the surface is damaged or deformed.

Further, the sheet is sandwiched between the belt 400 and the retard roller 450. The surface of the projecting portion 452 of the retard roller 450 is rough due to irregularity formed thereon and is rotated in such a state of being fitted between the belts 400. It was likely that the surface of the sheet is damaged when it comes in contact with the surface of the projecting portion 452, and as shown in FIG. 24, it was likely that a trace of contact with the projecting portion 452 appears on a sheet 500 as a belt-like scratch 501. Especially when only one sheet is fed by the pick-up roller 211, the surface of the sheet which is conveyed to the conveying passage and subjected to image forming is likely to be damaged.

The present invention was made in view of the problems described above, and its object is to provide a sheet-feeding mechanism capable of improving separability with respect to other sheet without damaging sheets, and a sheet-feeding device and an image forming apparatus provided with the sheet-feeding mechanism.

SUMMARY OF THE INVENTION

For the purpose of achieving the object described above, a sheet-feeding mechanism according to an aspect of the present invention includes: a feeding roller which rotates in a sheet-conveying direction, at least a surface of the feeding roller being flexible; and a retard roller having a plurality of press-contact rollers which come in press-contact with the feeding roller at a predetermined pressure to form a plurality of press-contact surface, and a hardness of the feeding roller and a hardness of the retard roller are different from one another.

According to the configuration described above, a sheet-feeding mechanism capable of improving separability with respect to other sheets without damaging the sheet, and a sheet-feeding device and an image forming apparatus provided with the sheet-feeding mechanism can be provided.

These and other objects, features and advantages of the present invention will become apparent upon reading of the following detailed description along with the accompanied drawings.

DETAILED DESCRIPTION OF THE PREFERRED EMBODIMENTS

Hereinafter, embodiments of the present invention will be described with reference to the drawings.

First Embodiment

Figure 1A:
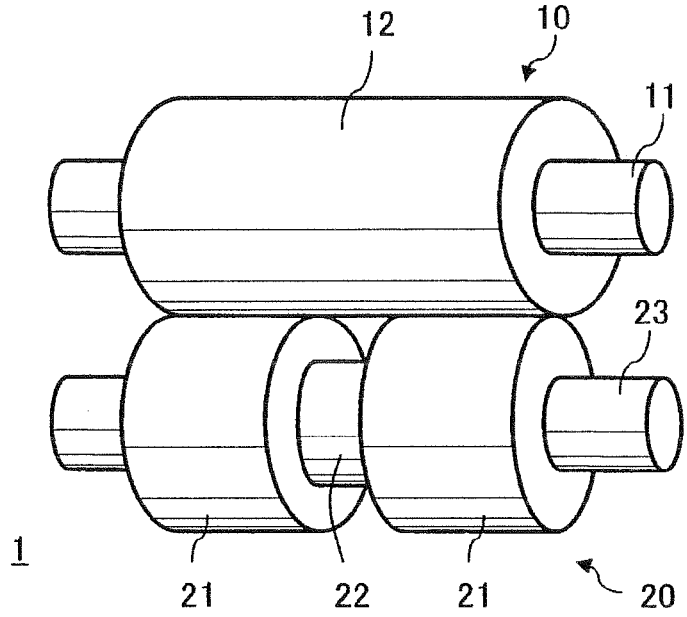
FIG. 1A is a perspective view schematically showing relevant parts of a sheet-feeding mechanism in accordance with a first embodiment of the present invention.
Figure 1B:
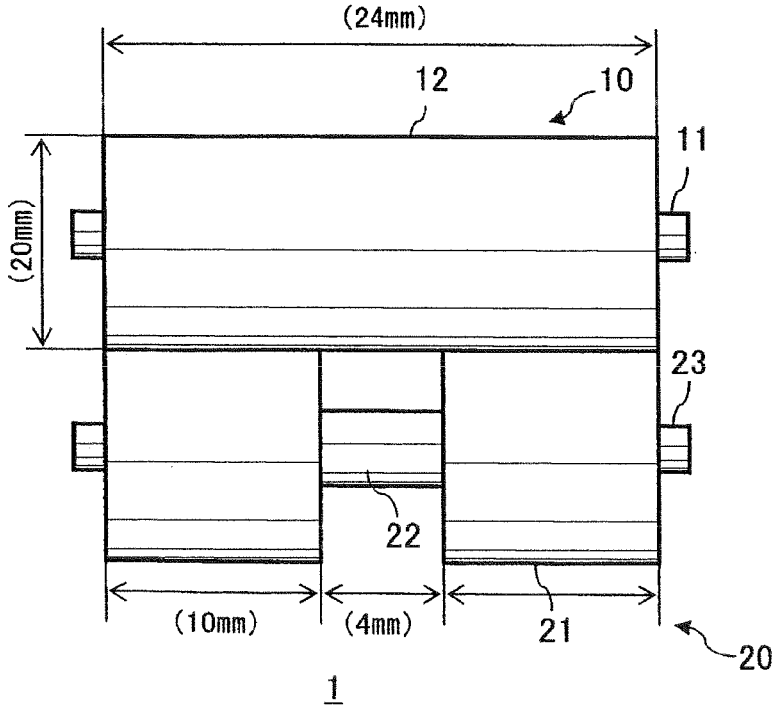
FIG. 1B is a front view schematically showing relevant parts of the sheet-feeding mechanism in accordance with the first embodiment of the present invention.
Figure 1C:
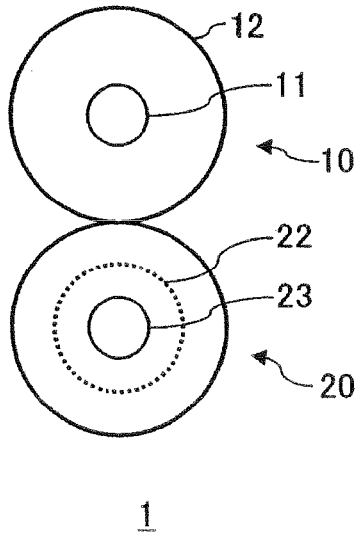
FIG. 1C is a side view schematically showing relevant parts of the sheet-feeding mechanism in accordance with the first embodiment of the present invention.

FIGS. 1A, 1B, and 1C are a perspective view, a front view, and a side view schematically showing relevant parts of a sheet-feeding mechanism in accordance with a first embodiment of the present invention.

In each of FIGS. 1A-1C, a sheet-feeding mechanism 1 includes a feeding roller 10, and a retard roller 20 so provided as to face the feeding roller 10.

Figure 18:
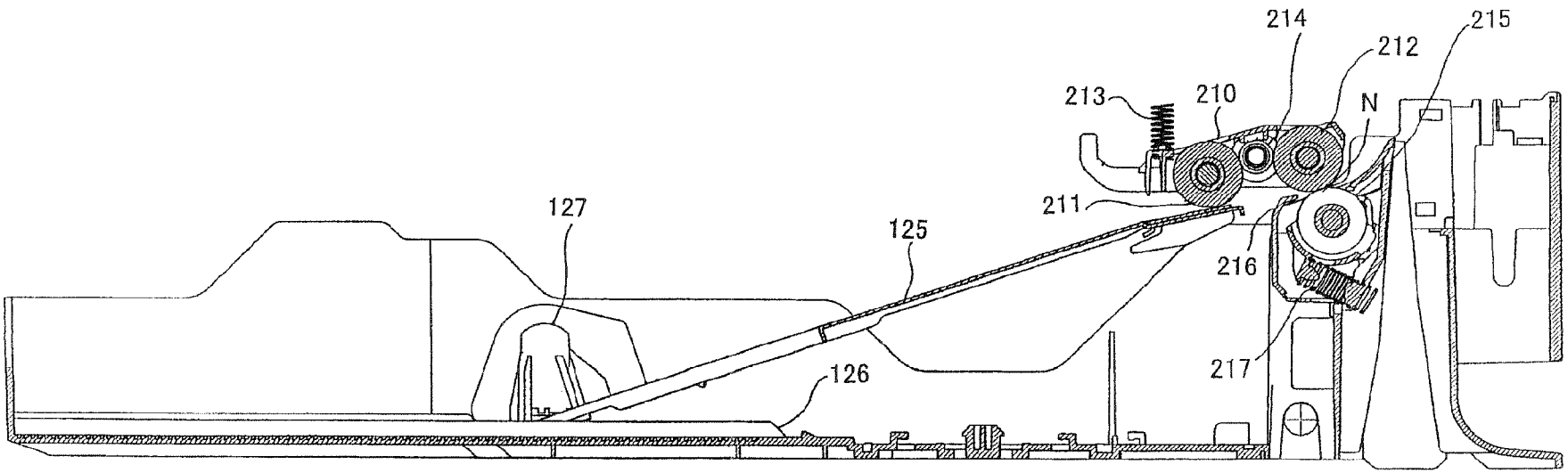
FIG. 18 is a side view schematically showing relevant parts of the sheet-feeding device 120.

The feeding roller 10 has a configuration which is similar to that of the feeding roller 212 of the conventional sheet-feeding mechanism 200 shown in FIG. 18. The feeding roller 10 includes a rotational shaft 11, to which a rotational drive force is transmitted from outside, and a contact member 12 which is provided around the rotational shaft and comes in contact with a sheet directly. As material of the contact member 12, elastic material such as a silicon rubber is used.

The retard roller 20 includes a pair of press-contact rollers 21 which come in contact with a surface of the contact member 12 of the feeding roller 10, a connecting shaft 22 for connecting the press-contact rollers 21, a rotational shaft 23 provided coaxially with the connecting shaft 22 and to which a rotational drive force is transmitted through an unillustrated torque limiter. Normally, a rotational drive force in a counter-clockwise direction (in FIG. 2) is exerted to the retard roller 20. However, when a frictional force becomes equal to or greater than a predetermined amount at a nip portion due to a contact with respect to the feeding roller 10, the torque limiter shuts down the transmission of a rotational drive force in the counter-clockwise direction (FIG. 2), so that the retard roller 20 rotates to follow rotation of the feeding roller 10 (in this case, it is a clockwise direction in FIG. 2). An elastic member such as a rubber is used as material of the press-contact rollers 21, similarly to the contact member 12. However, a hardness of material used in the press-contact rollers 21 is higher than that of the contact member 12.

In the example shown in FIG. 1B, the contact member 12 of the feeding roller 10 has an outer diameter of 20 mm and an entire length of 24 mm. Each of the pair of press-contact rollers 21 of the retard roller 20 has an outer diameter of 20 mm and an entire length of 10 mm, and the press-contact rollers 21 are so arranged that a clearance of 4 mm is formed therebetween, so that the size of the retard roller 20 is accommodated to the size of the feeding roller 10. The clearance between the press-contact rollers 21 faces an axially mid portion of the feeding roller 10. Further, a hardness of a rubber of the press-contact roller 21 is set to be 45°, and a hardness of a rubber of the contact member 12 is set to be 33°. An outer diameter of the feeding roller 10 and an outer diameter of the press-contact roller 21 of the retard roller 20 may be substantially equal as long as a difference therebetween falls within a range of an error in designing or a yield rate of a product.

In each of the drawings, sizes of parts of the rollers are shown in an exaggerated manner for easiness in description.

Figure 2:
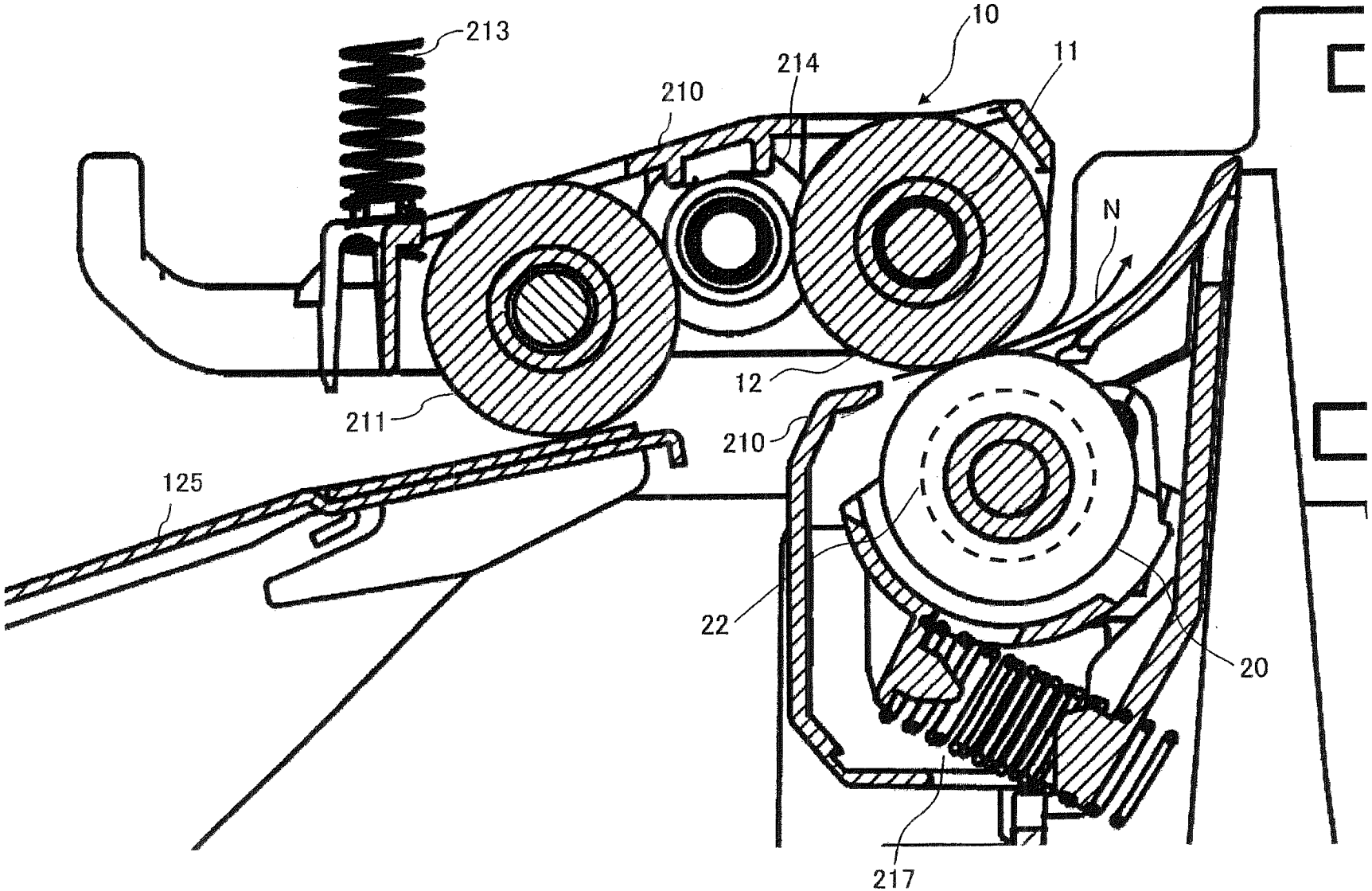
FIG. 2 is a sectional view showing configurations of relevant parts of a sheet-feeding device 120 including the sheet-feeding mechanism in accordance with the first embodiment of the present invention.
Figure 19:
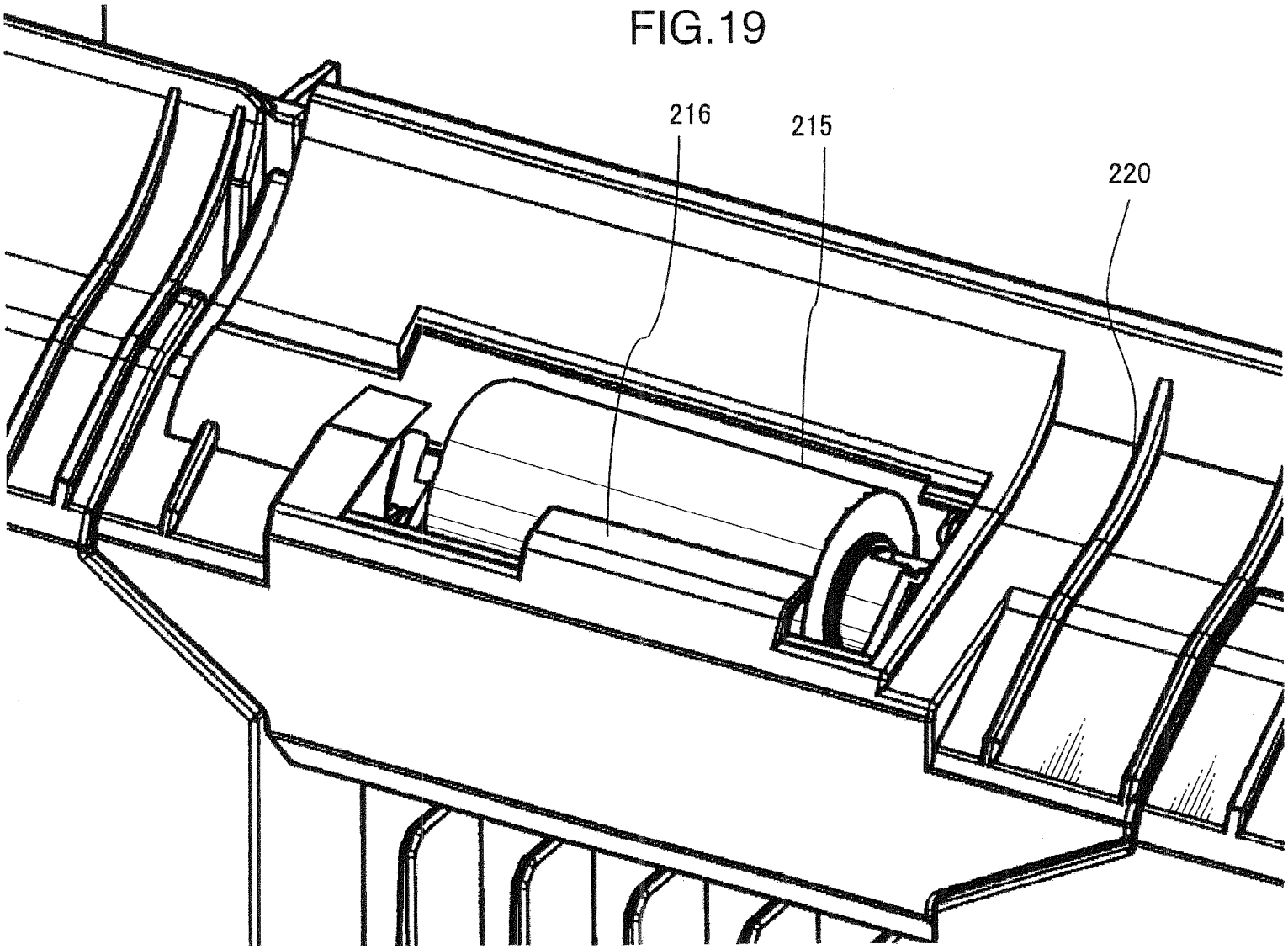
FIG. 19 is a perspective view schematically showing a configuration near a retard roller 215 of the sheet-feeding device 120.
Figure 20:
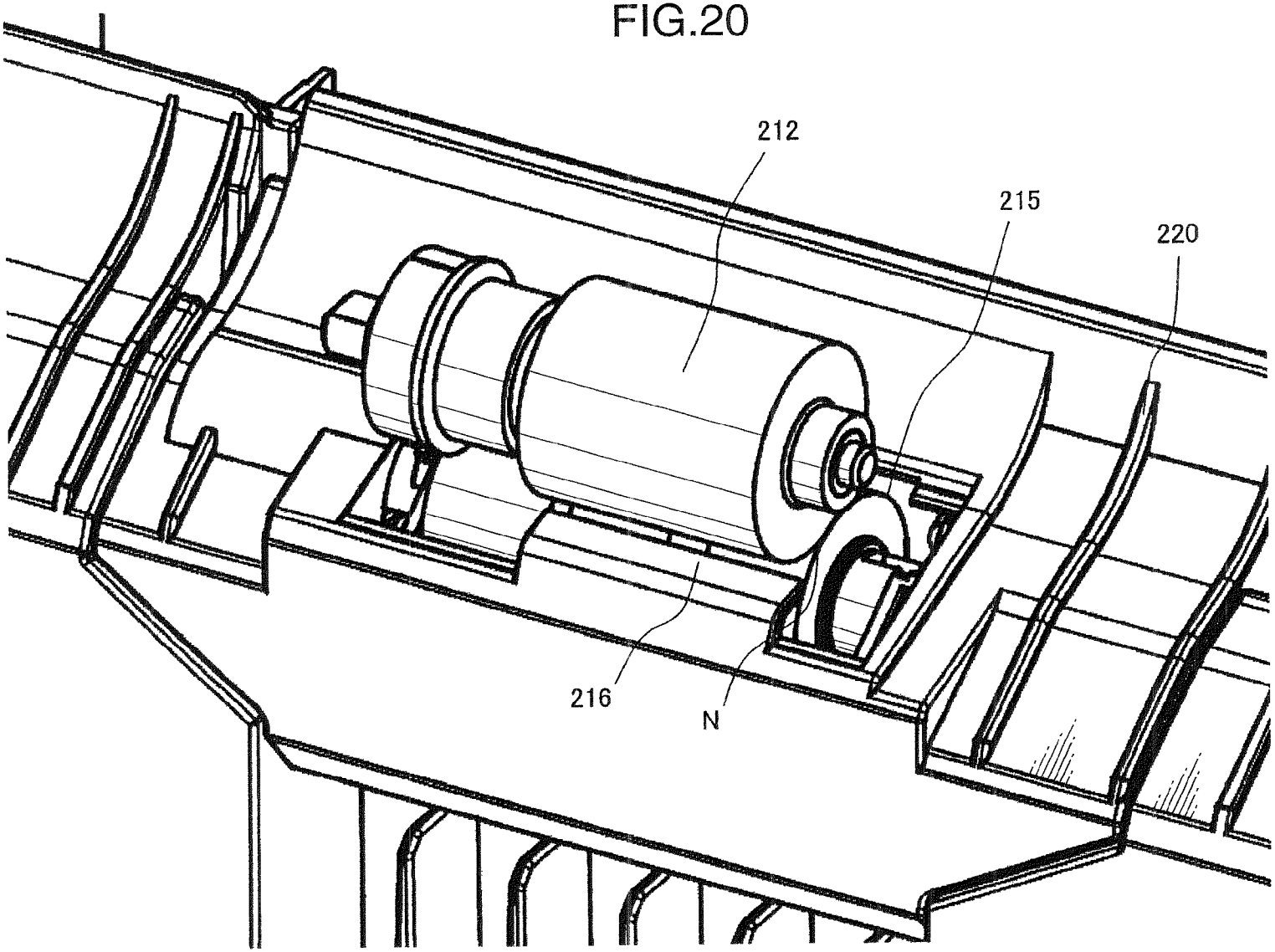
FIG. 20 is a perspective view schematically showing a positional relationship between a feeding roller 212 and the retard roller 215 in the sheet-feeding device 120.
Figure 21:
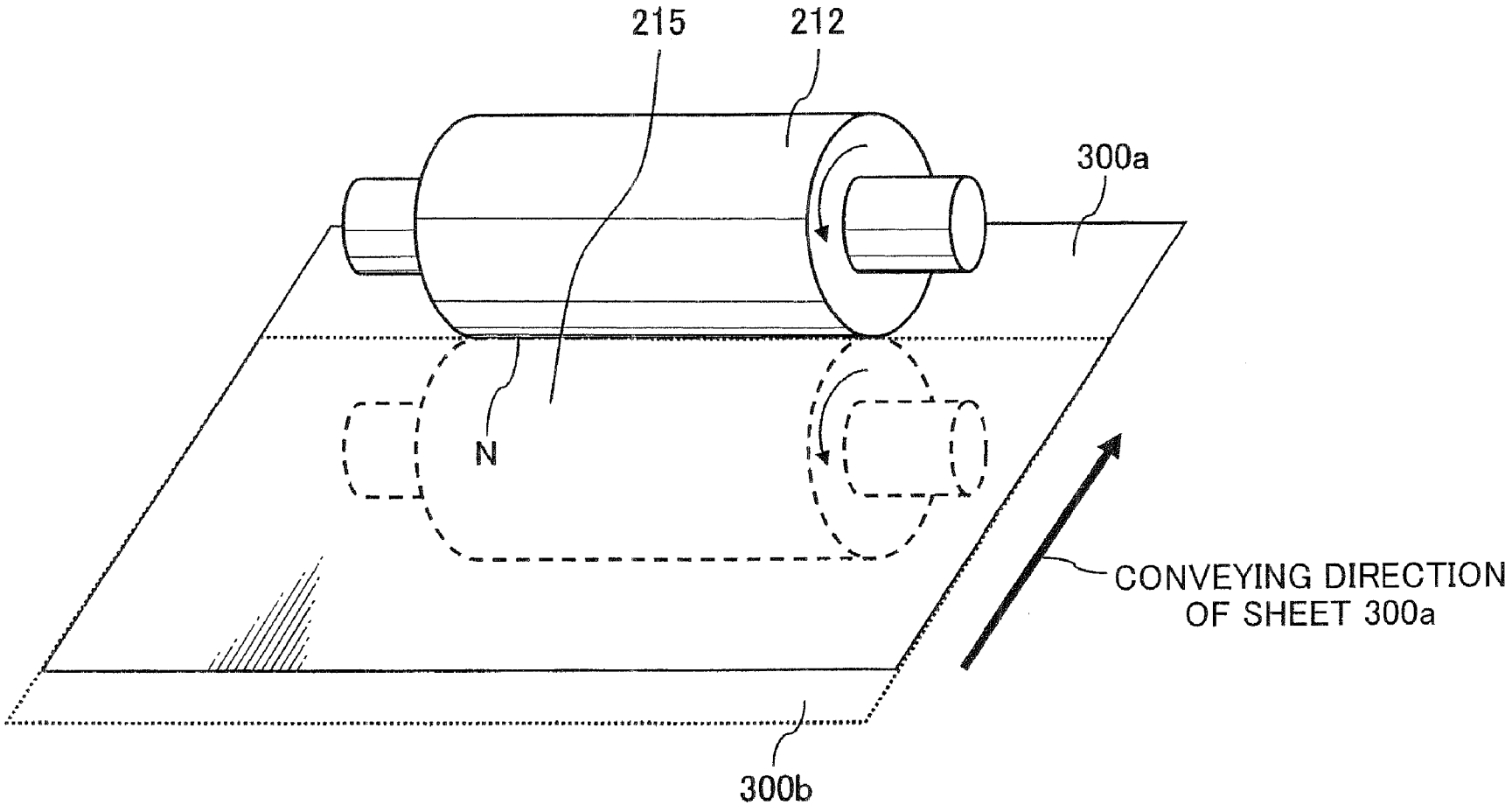
FIG. 21 shows operations of the feeding roller 212 and the retard roller 215.

By setting overall sizes of the feeding roller 10 and the retard roller 20 to be the same as those of the conventional sheet-feeding mechanism 200, other configurations of the sheet-feeding mechanism which are the same as those shown in FIGS. 18-20 may be used. In other words, as shown in FIG. 2 showing an enlarged view of relevant parts, the feeding roller 10 and the retard roller 20 constituting the sheet-feeding mechanism 1 can be mounted directly to the sheet-feeding device 120 for operation. The elastic member 217 exerts a biasing force, which is exerted toward the surface of the feeding roller 10, to the retard roller 20 so arranged as to face the feeding roller provided in the housing 20, so that the retard roller 20 is pressed by the feeding roller 10 at a predetermined nip pressure.

In the configuration described above, the feeding roller 10 corresponds to the feeding roller of the present invention, and the retard roller 20 corresponds to the retard roller of the present invention. The feeding roller and the retard roller constitute the sheet-feeding mechanism of the present invention. Further, the press-contact rollers 21 correspond to the press-contact rollers of the present invention.

A basic operation of the sheet-feeding mechanism 1, which has the configuration described above, in accordance with the embodiment of the present invention is similar to that of the conventional sheet-feeding mechanism. Referring to FIG. 2, if the pick-up roller 211 in contact with the sheet held on the tray 125 follows rotation of the feeding roller 10 to send out the sheet, the sheet is guided along the cover 216 to the nip portion N formed by the feeding roller 10 and the retard roller 20.

When only one sheet is sent to the feeding roller 10, a force in opposite directions is applied to the sheet by the feeding roller 10 and the retard roller 20. However, transmission of a rotational torque exerted to the retard roller 20 is shut off by a load which is greater than a predetermined amount applied to the retard roller 20, and then the retard roller 20 is rotated in a direction of following the rotation of the feeding roller 10 (the retard roller 20 rotates in a clockwise direction: FIG. 2). Then, the sheet is sent to outside of the sheet-feeding device.

On the other hand, when two or more sheets in a stacked state are guided to a clearance defined between the feeding roller 10 and the retard roller 20, the uppermost sheet comes in contact with the surface of the feeding roller 10 rotating in the conveying direction and is sent to an inner side. On the other hand, the sheet on the lower side is pushed back to the direction opposite to the conveying direction of the sheet indicated by the arrow N in the drawing due to rotation of the retard gear 20 in the opposite direction with respect to the sheet-conveying direction (counter-clockwise direction in FIG. 2).

The sheet-feeding mechanism 1 in accordance with the first embodiment of the present invention is so configured as to have the feeding roller 10 and the retard roller 20 having the plurality of press-contact rollers 21 as shown in FIGS. 1A-1C, so that its basic operation described above achieves the following effect.

Figure 3:
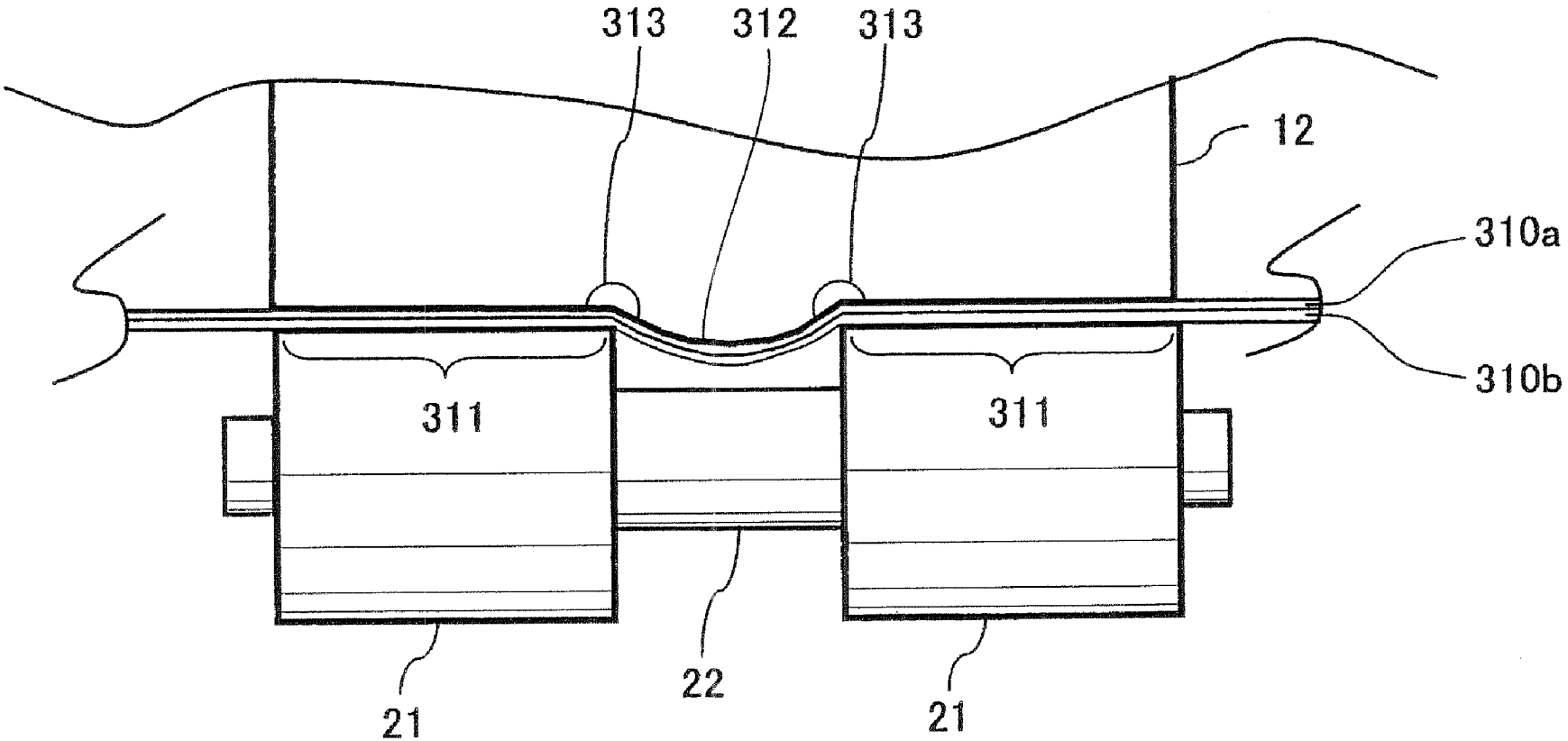
FIG. 3 shows the effect of the sheet-feeding mechanism in accordance with the first embodiment of the present invention.

FIG. 3 shows a state where, in the sheet-feeding mechanism 1 in accordance with the present embodiment, two sheets 310*a* and 310*b* are inserted at the same time between the feeding roller 10 and the retard roller 20. As shown in FIG. 3, a biasing force exerted by the elastic member 217 shown in FIG. 2 causes the press-contact rollers 21 of the retard roller 20 to come in press contact with the contact member 12 of the feeding roller 10, so that the contact member 12 of the feeding roller 10 is deformed, and a pair of adjacent press-contact surfaces 311 are formed. The press-contact surfaces 311 become the nip portion.

On the other hand, since an external force is not exerted to a portion of the contact member 12 between the press-contact surfaces 311, the portion is so deformed as to bulge toward the connecting shaft 22 to form the bulging portion 312. At borders between the bulging portion 312 and the press-contact surfaces 311, end portions of the press-contact rollers 21 are in press contact so that edge portions 313 are formed.

The sheets 310*a* and 310*b* are guided to a position between the feeding roller 10 and retard roller 20 and urged to come in press-contact by the bulging portion 312 and the pair of edge portions 313 on opposite sides thereof. Therefore, a cross-sectional shape of the sheets 310*a* and 310*b* viewed from the sheet-conveying direction becomes a wave-like shape. At this time, the sheet 310*b* in contact with the retard roller 20 is deformed along the bulging portion 312 and fitted between the press-contact surfaces 311, so that a retaining force is improved. On the other hand, the sheet 310*a* in contact with the feeding roller 10 is pressed toward the press-contact surfaces 311 including the edge portions 313, so that a contact with respect to the surface of the contact member 12 becomes stronger.

Thus, the sheet in contact with the feeding roller 10 and the sheet in contact with the retard roller 20 are strongly retained by the rollers respectively, so that effect of improving separability can be achieved.

Further, when three or more sheets are guided in a stacked state, separability may be improved in accordance with the following reasons.

Figure 4:
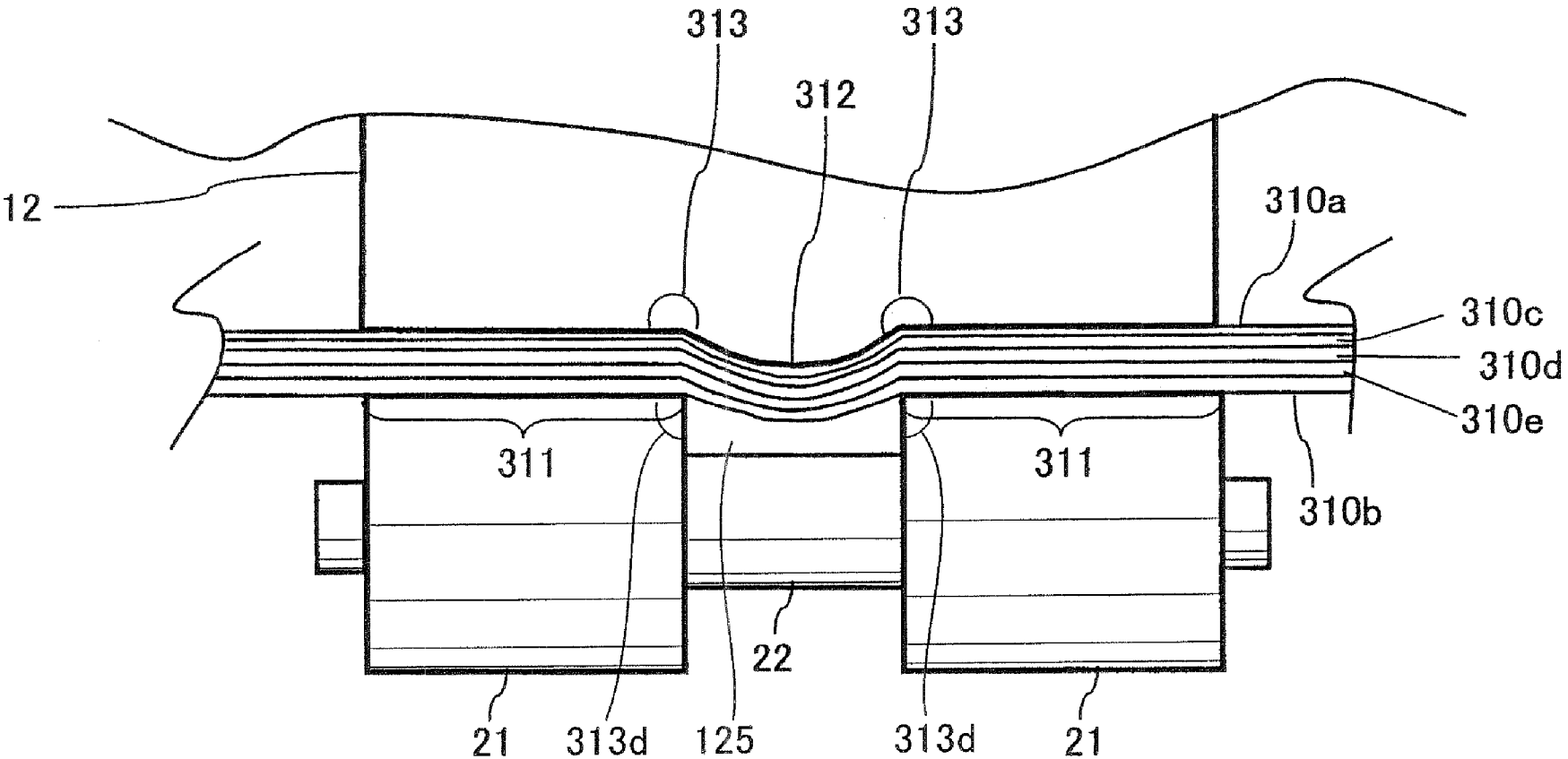
FIG. 4 shows the effect of the sheet-feeding mechanism in accordance with the first embodiment of the present invention.

FIG. 4 shows a state where five sheets 310*a*-310*e* are inserted to a position between the feeding roller 10 and the retard roller 20 at the same time. The sheet 310*a* comes in contact with the feeding roller 10 directly, and the sheet 310*b* comes in contact with the press-contact rollers 21 directly. The sheets 310*c*, 310*d*, and 310*e* are layered between the sheet 310*a* and the sheet 310*b*.

In the configuration of the present embodiment, the bulging portion 312 and the pair of edge portions 313 cause the stacked sheets 310*a*-310*e* to come in press-contact. Therefore, a cross-sectional shape of the sheets 310*a*-310*e* viewed from the sheet-conveying direction has a wave-like shape along the shape formed by the bulging portion 312 and the edge portions 313. At this time, it is considered that the sheets 310*a*-310*e* are banded together and integrated by the pressure from the rollers and formation of the wave-like shape.

The banded sheets 310*a*-310*e* receive a force in opposite directions from the feeding roller 10 and the retard roller 20. The sheets 310*b*-310*e*, which are other than the sheet 310*a* in direct and close contact with the feeding roller 10, are separated from the sheet 310*a* and put back to the tray 126 similarly to the sheet 310*b* shown in FIG. 3 while maintaining the state of being banded by deformation. In other words, as shown in FIG. 4, when the sheets are conveyed in a layered state, the sheets are deformed to be the wave-like shape at the edge portions 313, 313*d*. In this case, deformation of the sheets in lower layers pressed by the retard roller 20 having a higher hardness becomes acuter at the edge portions (the portions of 313*d* in FIG. 4), and deformation of the sheets in upper layers becomes looser. As described above, acute deformation of the sheets in the lower layers causes stress to be intensive at the deformed portion of the sheet. The stress serves as a pressure to the sheets in the lower layers, and the sheets in the lower layers are likely to be banded and integrated. In this case, comparing a frictional force (1) exerted between the uppermost sheet 310*a* and the feeding roller 10 with a retaining force (2) due to a frictional force exerted between the sheet 310*a* and the sheet 310*c* just under the same, if normal copying sheets are used, the frictional force (1) wins over the retaining force (2). Thus, the sheet 310*a* in the uppermost layer is conveyed along the rotation of the feeding roller 10, and other lower sheets 310*b*-310*e* band together and moves back in accordance with the counter-clockwise rotation (FIG. 2) of the retard roller 20.

As described above, in the first embodiment, the sheets 310*b*-310*d* which should follow the rotation of the retard roller 20 are more likely to be integrally retained with respect to the sheet 310*a* which should follow the rotation of the feeding roller 10. Therefore, even when three or more sheets, while in a stacked state, are guided to a position between the rollers, favorable separability can be secured.

In the description above, the bulging portion 312 is shown in an exaggerated manner. However, if the sheet is deformed within about 1 mm with respect to the surfaces of the press-contact surfaces 311, the sheet can be deformed to have a suitable wave-like shape, so that the effect of improving separability as described above can be acquired.

Figure 5:
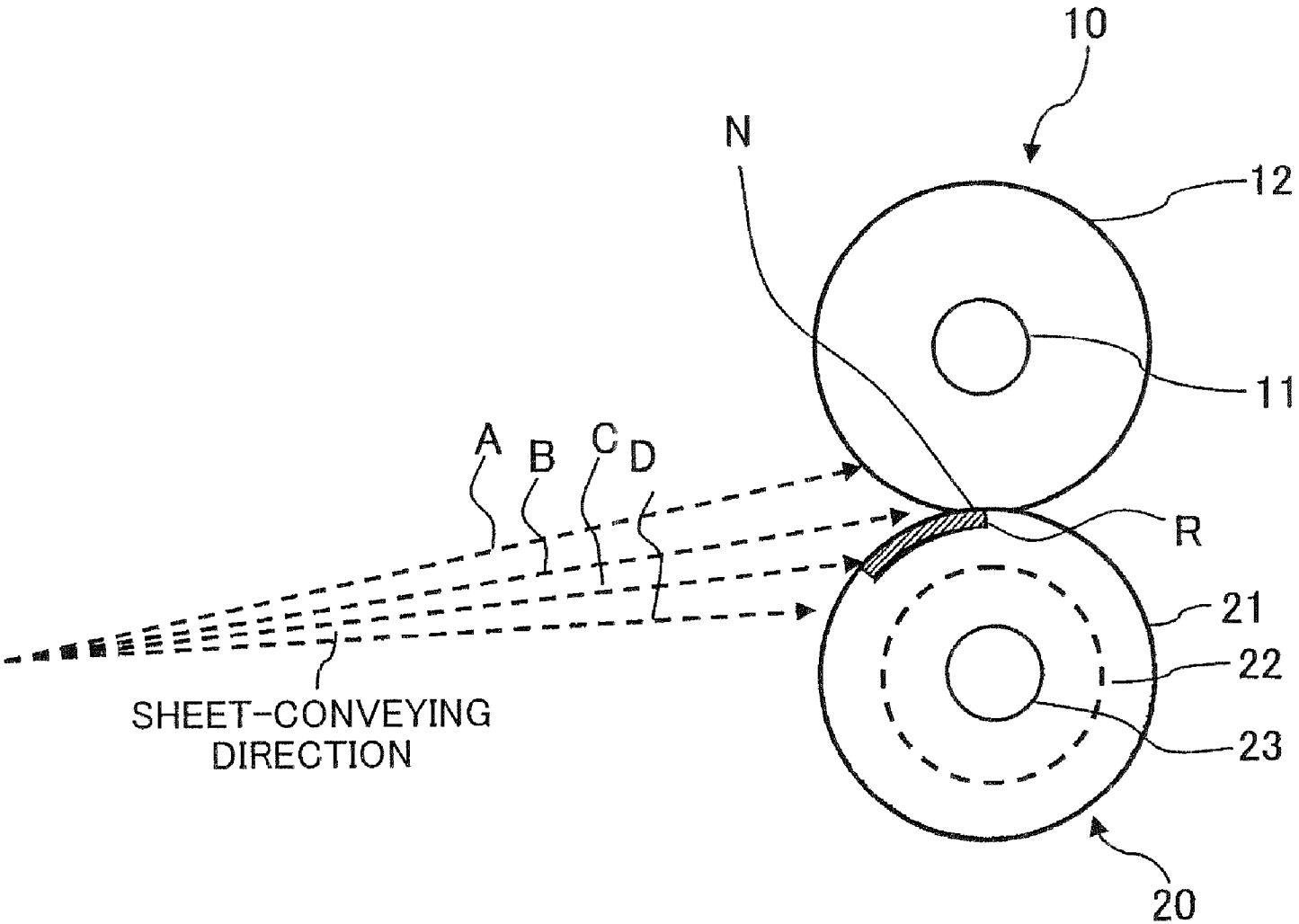
FIG. 5 shows the effect of the sheet-feeding mechanism in accordance with the first embodiment of the present invention.

Next, FIG. 5 shows another effect of the sheet-feeding mechanism 1 in accordance with the present embodiment. As shown in FIG. 1C, the feeding roller 10 and the press-contact rollers 21 of the retard roller 20 have equal outer diameter. Therefore, the sheet-conveying directions A-D indicated by broken lines in the drawing can be sorted into the following cases: the sheet firstly comes in contact with the contact member 12 of the feeding roller 10 (conveying direction A); the sheet is guided directly to the nip portion N between the feeding roller 10 and the retard roller 20 (conveying direction B); and the sheet firstly comes in contact with the press-contact rollers 21 of the retard roller 20 (conveying directions C, D). Among those, the conveying directions C, D cause a damage to the sheet. The press-contact rollers 21 of the retard roller 20 in accordance with the first embodiment are different from the technology shown in the patent document 1 in that since surface machining such as irregularity for improving separability is not applied, the sheet can be slipped along the surface of the retard roller and guided to the nip portion N even in a case where an end portion of the sheet comes in contact with the press-contact rollers 21 at the angle of conveying direction C. The shaded area R in FIG. 5 is an area where the end portion of the sheet is permitted to come in contact with the retard roller 20. If the end portion collides in the conveying direction D on the further lower side, the sheet is rolled into the lower side in the drawing along the rotational direction of the retard roller 20. However, as shown in FIG. 2, when the sheet-feeding mechanism 1 is mounted to the sheet-feeding device 120, the portion is actually covered with the cover 216. Therefore, the sheet is guided to the nip portion along the surface of the cover 216, so that all of conveyed sheets can be guided appropriately to the nip portion N.

As described above, according to the sheet-feeding mechanism in accordance with the present embodiment, separability can be improved while preventing the sheet from colliding with the retard roller to be damaged.

Second Embodiment

Figure 6A:
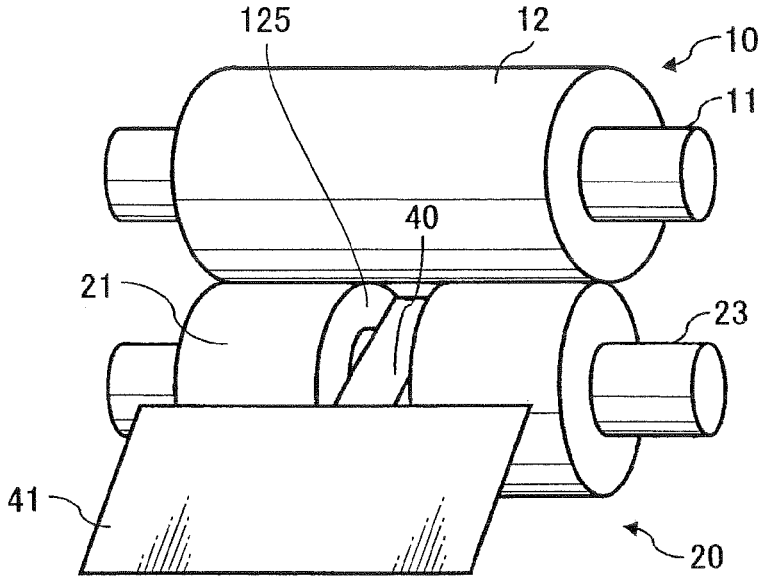
FIG. 6A is a perspective view schematically showing relevant parts of a sheet-feeding mechanism in accordance with a second embodiment of the present invention.
Figure 6B:
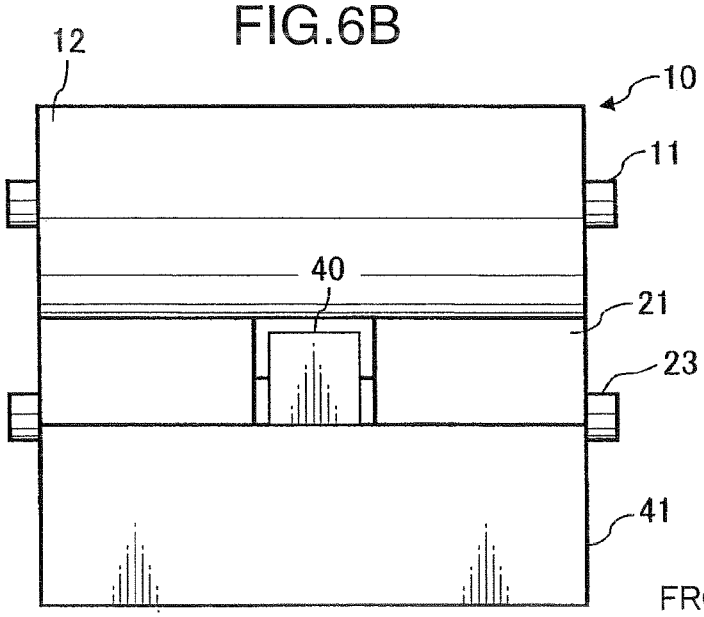
FIG. 6B is a front view schematically showing relevant parts of the sheet-feeding mechanism in accordance with the second embodiment of the present invention.
Figure 6C:
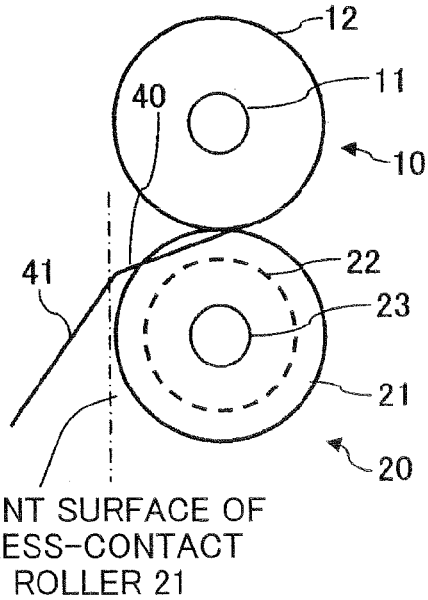
FIG. 6C is a side view schematically showing relevant parts of the sheet-feeding mechanism in accordance with the second embodiment of the present invention.

FIGS. 6A, 6B, and 6C are a perspective view, a front view, and a side view schematically showing relevant parts of a sheet-feeding mechanism in accordance with a second embodiment of the present invention. The portions which are the same as or corresponding to the portions of FIGS. 1A-1C are identified by the same reference signs, and detailed descriptions will be omitted. Further, the element identified by the reference numeral 40 is a guide member which is a plate member provided between the press-contact rollers 21 and made of resin or the like. Further, the element identified with the reference numeral 41 is a supporting member for fixing the guide member 40. As the supporting member 41, a part of a housing of the sheet-feeding device 120 can be used, as will be described hereinafter.

Figure 7:
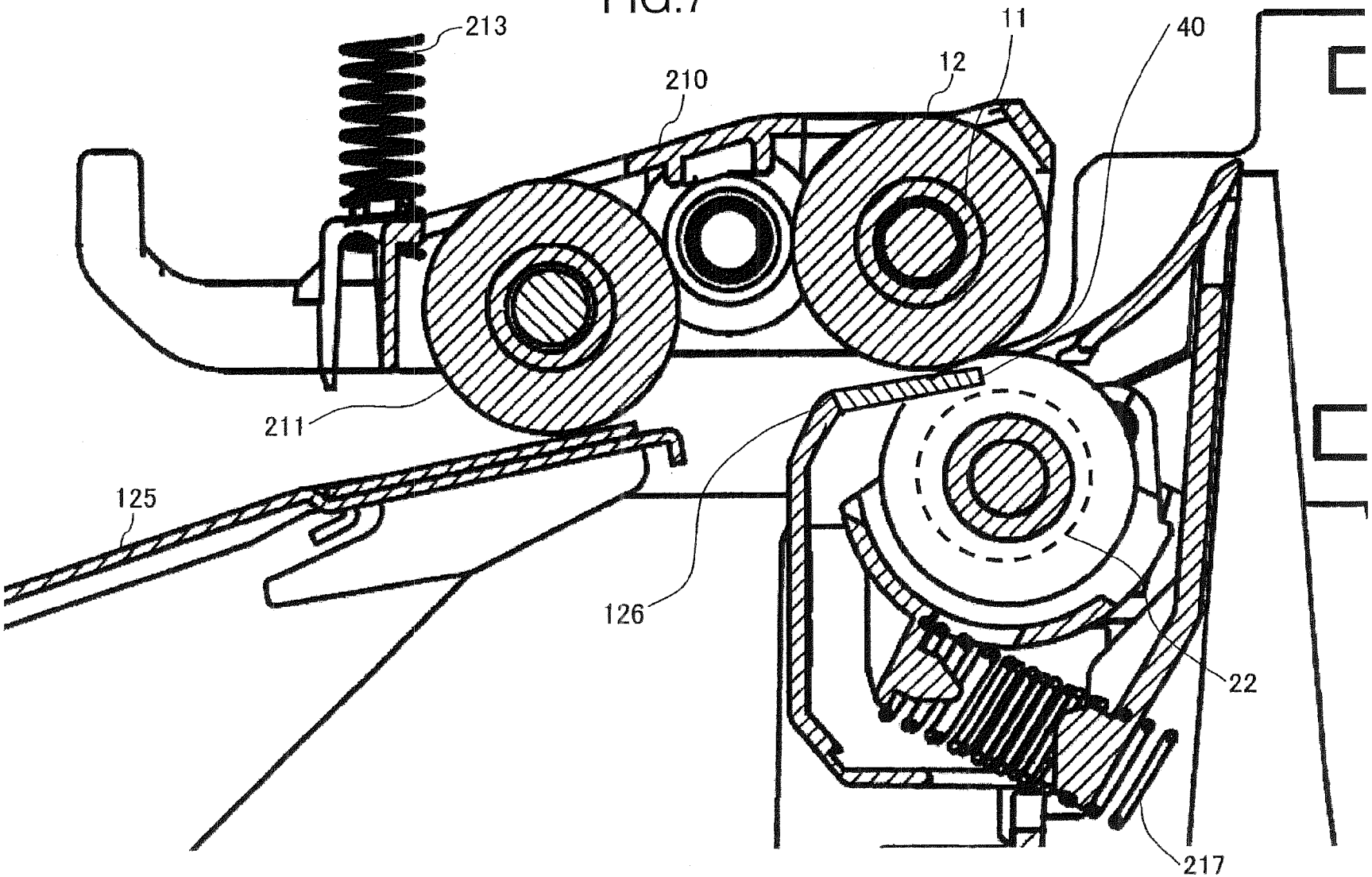
FIG. 7 is a sectional view showing configurations of relevant parts of a sheet-feeding device 120 including the sheet-feeding mechanism in accordance with the second embodiment of the present invention.
Figure 8:
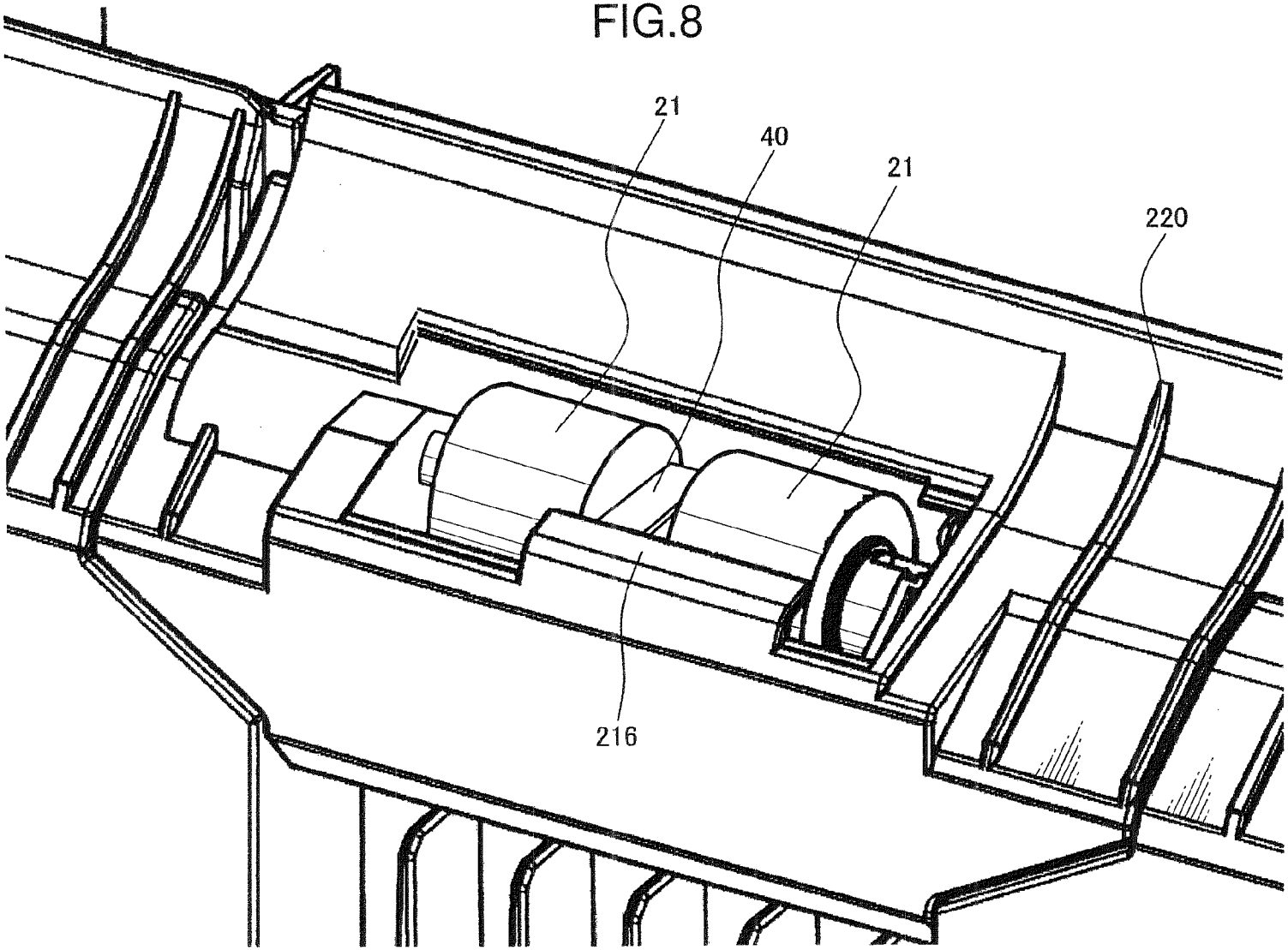
FIG. 8 is a perspective view showing configurations of relevant parts of the sheet-feeding device 120 including the sheet-feeding mechanism in accordance with the second embodiment of the present invention.

Further, FIG. 7 is a sectional view schematically showing a state where the sheet-feeding mechanism in accordance with the present embodiment is mounted to the sheet-feeding device 120, and FIG. 8 is a perspective view schematically showing a configuration around the retard roller 20 of the sheet-feeding device 120 to which the sheet-feeding mechanism in accordance with the present embodiment is mounted. The elements which are the same as or corresponding to those of FIG. 2 and FIG. 6 are identified with the same reference numerals, and detailed description will be omitted. Each drawing shows a configuration in which the cover 216 is used as the supporting member 41 shown in FIGS. 6A-6C, and the guide member 40 is provided as a separate member to the cover 216. It is preferable that the guide member 40 is made of resin such as Lumirror. The Lumirror has a smooth surface, so that it can prevent the sheet from being damaged.

The sheet-feeding mechanism in accordance with the second embodiment has a feature that the guide member 40 is provided between the retard roller 20 and the press-contact roller 21. As shown in FIG. 6C, the guide member 40 has a configuration that, as indicated by one-dotted chain lines in the drawing, it extends from a further front side of the front surface of the press-contact roller 21 to the nip portion between the feeding roller 10 and the retard roller 20. Accordingly, the sheet guided from the tray once comes in contact with the guide member 40 and then is guided to the nip portion along the surface of the guide member 40. This prevents the leading end of the sheet from colliding with the surface of the retard roller 20 at a steep angle.

Further, the guide member 40 achieves an effect of restricting the sheet-feeding direction of the sheet on a more rear side than the conventional cover 216.

Regarding the size of the guide member 40, when the feeding roller 10 and the retard roller 20 have sizes which are similar to those of the first embodiment, it is necessary that the guide member 40 has a width which can be accommodated within 4 mm (in other words, smaller than 4 mm) clearance of the pair of press-contact rollers 21. However, for the purpose of improving the effect of restricting the sheet-conveying direction, it is preferable that it has a wider width. For example, the contact member 12 of the feeding roller 10 has an outer diameter of 20 mm and an entire length of 24 mm, similarly to the first embodiment. On the other hand, the retard roller 20 includes a pair of press-contact rollers 21 each having an outer diameter of 20 mm and an entire length of 8 mm, and the press-contact rollers 21 are arranged with a clearance of 8 mm therebetween. Accordingly, the guide member 40 having a width of smaller than 8 mm can be used. Setting the entire length of each press-contact roller to be shorter than 8 mm is not so preferable since it may cause the effect of conveying and separating the sheet to be reduced.

In the configuration described above, the guide member 40 is a member which is separate from the cover 216. However, the guide member 40 may be molded integrally with the cover 216.

Figure 9A:
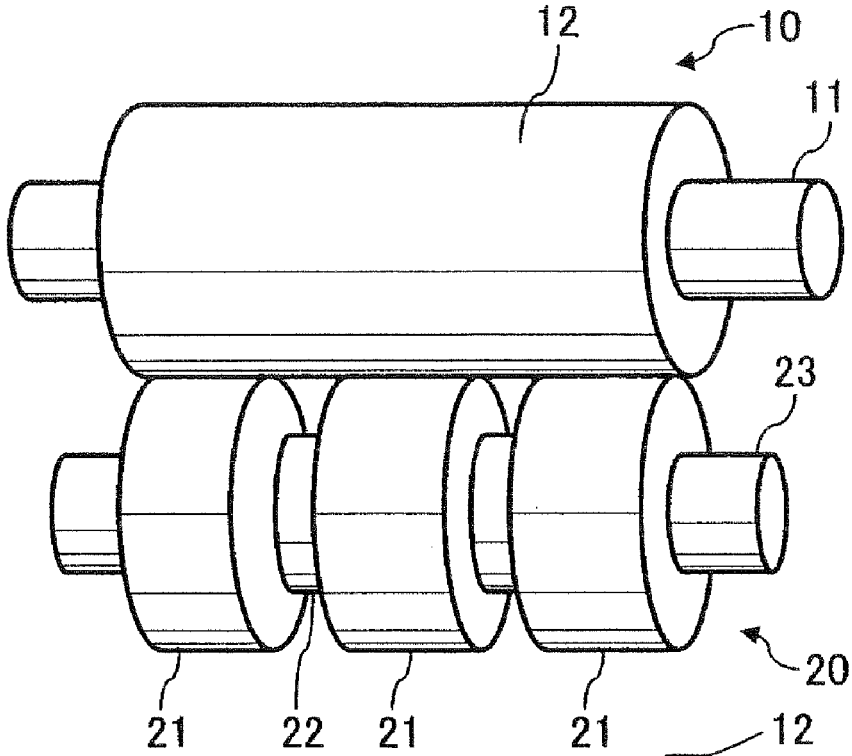
FIG. 9A is a perspective view showing another configuration of the sheet-feeding mechanism in accordance with the present invention.
Figure 9B:
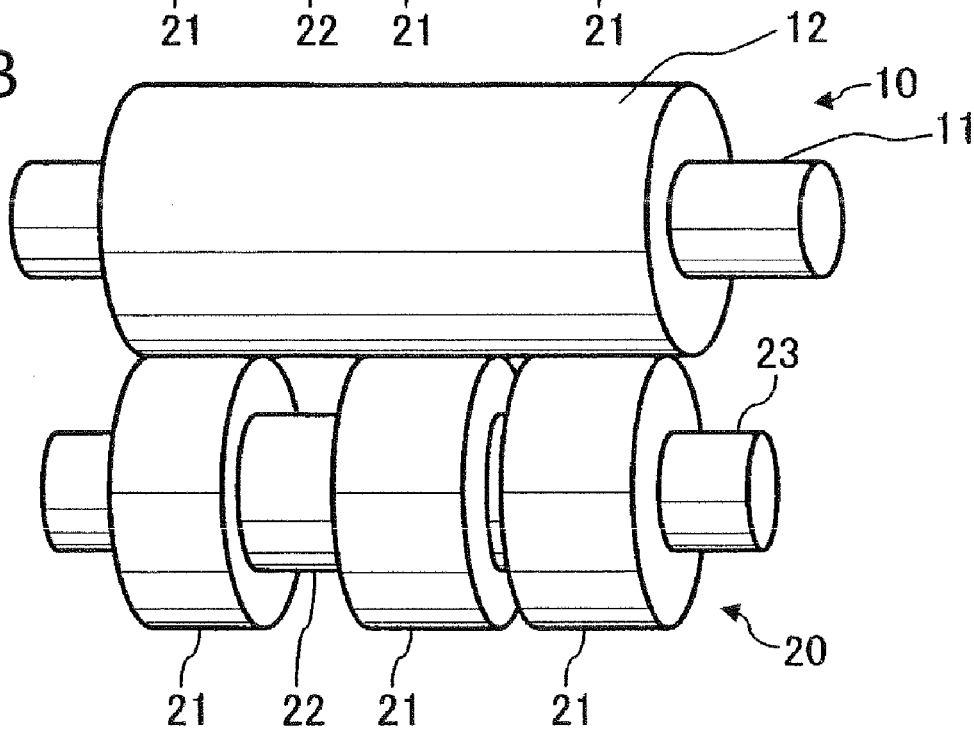
FIG. 9B is a perspective view showing another configuration of the sheet-feeding mechanism in accordance with the present invention.

Further, in the description above, the retard roller 20 has a configuration in which the pair of press-contact rollers 21 are arranged symmetrically. However, the plurality of press-contact rollers according to the present invention may be three or more. FIGS. 9A and 9B show a configuration including three press-contact rollers 21. In FIG. 9A, the press-contact rollers 21 are arranged at equal interval. However, as shown in FIG. 9B, the clearance may be different from one another. Further, the press-contact rollers 21 may have widths different from one another, and press-contact surfaces having different lengths with respect to the feeding roller 10. In summary, it is sufficient if the press-contact rollers according to the present invention come in press-contact with the feeding roller at a predetermined pressure to form a plurality of press-contact surfaces. The size, number, arrangement, or the like is not limited.

Further, in the configuration described above, the overall sizes of the feeding roller 10 and the retard roller 20 are the same. However, it may be so configured that the diameters are different from one another. Especially, making the diameter of the feeding roller 10 be larger than the diameter of the press-contact rollers 21 of the retard roller makes a possibility that the conveyed sheet comes in contact with the feeding roller 10 be higher, so that guiding to the press-contact portion can be made easier.

Further, in the configuration described above, the contact member 12 of the feeding roller 10 and the retard roller 20 are both made of rubber. However, as long as the feeding roller is made of material having elasticity, it is not limited to the rubber. Further, according to the configuration described above, the press-contact rollers 21 are made of rubber having a hardness which is higher than that of the contact member 12. However, it may be made of metal or resin. In other words, regarding the feeding roller and the retard roller according to the present invention, as long as areas sandwiched by the press-contact surface of the feeding roller are deformed due to a difference in a hardness between the press-contact rollers and the feeding roller, the feeding roller and the press-contact rollers are not limited by particular structure and material.

In each of the embodiments, the sheet-feeding mechanism 1 is mainly described. However, the present invention may be realized as a sheet-feeding device provided with the sheet-feeding mechanism according to the present invention. In this instance, pick-up roller 211 corresponds to the pick-up roller according to the present invention, and the tray 125 corresponds to the tray according to the present invention, and other structures such as the bottom surface 126 and the cover 216 correspond to the housing according to the present invention.

Figure 17:
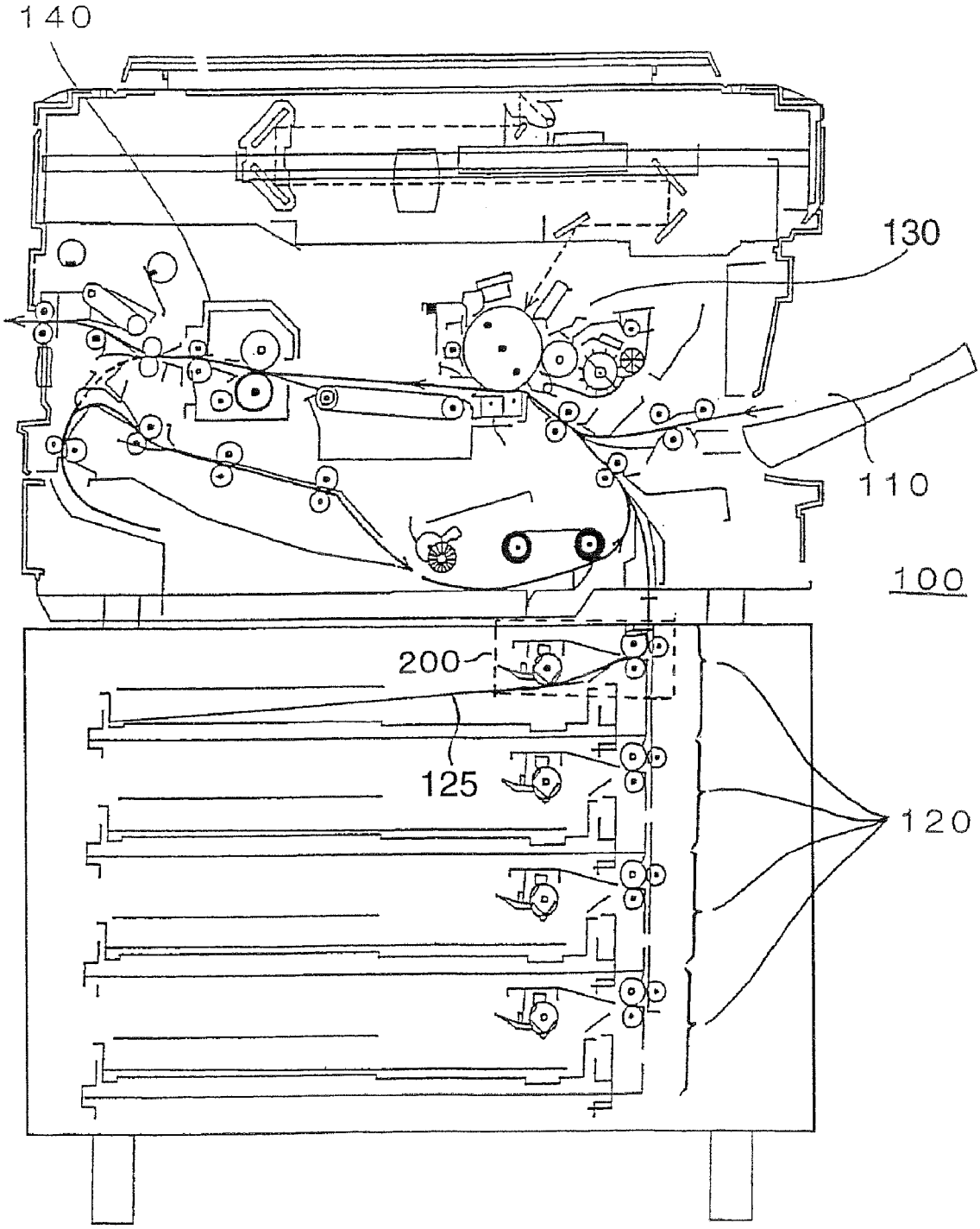
FIG. 17 schematically shows a configuration of an image forming apparatus 100.

Further, in the image forming apparatus shown in FIG. 17, an image forming apparatus provided with a sheet-feeding device according to the present invention as a sheet-feeding device may be included in the present invention. In this instance, the image forming section 130 corresponds to the image forming section according to the present invention, and the image fixing section 140 corresponds to the image fixing section according to the present invention.

Third Embodiment

Hereinafter, a third embodiment according to the present invention will be described with reference to the drawings.

Figure 10A:
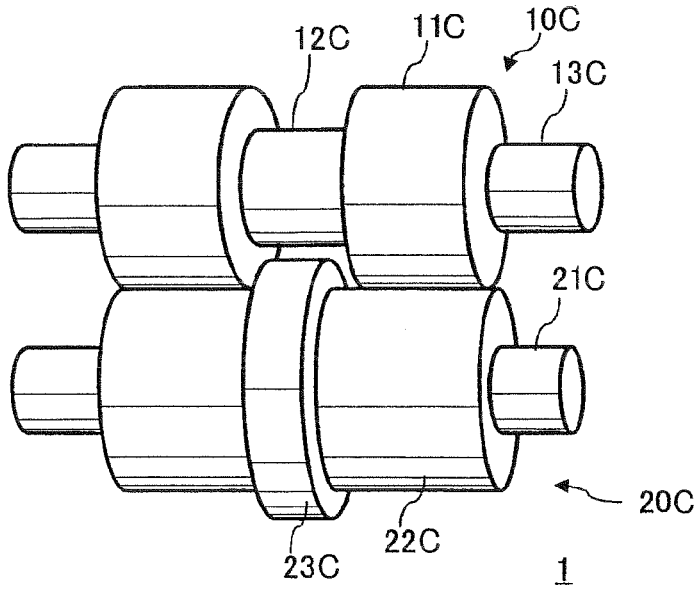
FIG. 10A is a perspective view schematically showing relevant parts of a sheet-feeding mechanism in accordance with a third embodiment of the present invention.
Figure 10B:
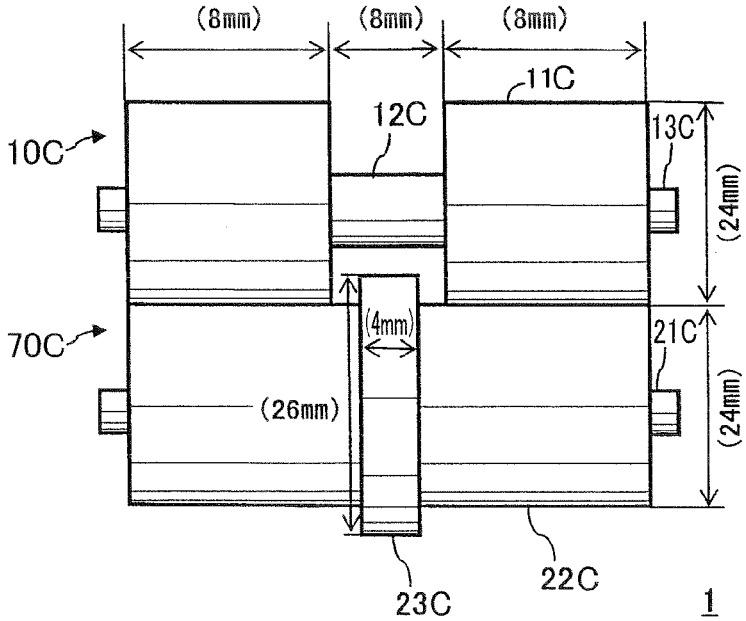
FIG. 10B is a front view schematically showing relevant parts of the sheet-feeding mechanism in accordance with the third embodiment of the present invention.
Figure 10C:
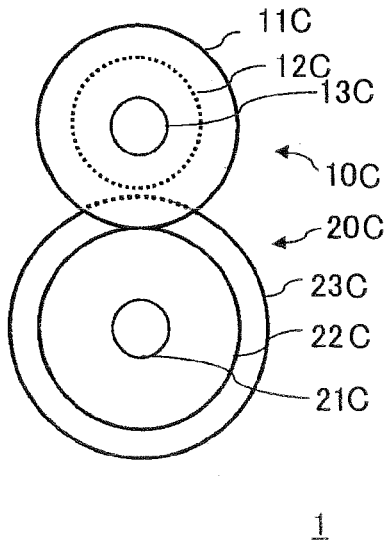
FIG. 10C is a side view schematically showing relevant parts of the sheet-feeding mechanism in accordance with the third embodiment of the present invention.

FIGS. 10A, 10B, and 10C are a perspective view, a front view, and a side view schematically showing relevant parts of the sheet-feeding mechanism in accordance with the third embodiment of the present invention.

In FIGS. 10A-10C, the sheet-feeding mechanism 1 includes a feeding roller 10*c* and a retard roller 20*c* so provided as to face the feeding roller 10*c*.

The feeding roller 10*c* includes a pair of press-contact rollers 11*c*, a connecting shaft 12*c* for connecting the press-contact rollers 11*c*, and a rotational shaft 13*c* provided coaxially with the connecting shaft 12*c* and to which a rotational drive force is transmitted from outside. The press-contact roller 11*c* are rollers which come in contact with the surface of the contact member 22*c* of the retard roller 20*c*, and is made of elastic material such as silicon rubber.

Further, the retard roller 20*c* includes a rotational shaft 21*c* to which a rotational drive force is transmitted from outside through an unillustrated torque limiter, a contact member 22*c* which is provided around the rotational shaft and comes in direct contact with the sheet, and a projecting portion 23*c* which is provided on an outer periphery of the contact member 22. As material of the contact member 22*c*, similarly to the press-contact roller 11*c*, an elastic member such as rubber is used. The press-contact rollers 11*c* and the contact member 22*c* may be made of the same kind of material.

Further, as shown in FIGS. 10A and 10B, the projecting portion 23*c* is provided at an axially mid portion of the contact member 22*c*, and its surface faces a clearance formed between the pair of the press-contact rollers 11*c* of the feeding roller 10*c*. Accordingly, the press-contact rollers 11*c* and the contact member 22*c* come in contact with each other at a predetermined pressure to form a nip portion.

Further, as material of the projecting portion 23*c*, polyoxymethylene (POM) material is used. The POM material has excellent rub resistance, and has a surface having a smoothness which is higher as compared to rubber material of the contact member 22*c* and the press-contact rollers 11*c*.

In the example shown in FIG. 10B, each of the press-contact rollers 11*c* of the feeding roller 10*c* has a diameter of 24 mm and an entire length of 8 mm, and a clearance of 8 mm is defined at an axially mid portion. Accordingly, an entire length of the feeding roller 10*c* is 24 mm. Further, the retard roller 20*c* includes a contact member 22*c* having a diameter of 24 mm and an entire length of 24 mm in conformity with the entire length of the feeding roller 10*c*, and a projecting portion 23*c* having a width of 4 mm is formed at an axially mid portion. A diameter of the projecting portion 23*c* is set to be 26 mm. Thus, the surface of the projecting portion 23*c* projects from the surface of the contact member 22*c* by about 1 mm. However, each drawing is shown in an exaggerated manner for easiness in description of sizes of the projecting portion 23*c*. Further, the size of other pats of the roller is also shown in an exaggerated manner for easiness in description.

By setting the overall sizes of the feeding roller 10*c* and the retard roller 20*c* to be the same as those of the conventional sheet-feeding mechanism 200, other configurations of the sheet-feeding mechanism may be the same as the parts shown in FIGS. 18-20. In other words, as shown in an enlarged view, which shows relevant parts, of FIG. 11, the feeding roller 10*c* and the retard roller 20*c* constituting the sheet-feeding mechanism 1 can be mounted directly to the sheet-feeding device 120 for operation. The retard roller 20*c* which is so arranged as to face the feeding roller 10*c* provided in the housing 210 is applied by the elastic member 217 with a biasing force of moving toward the surface of the feeding roller 10*c*, and the retard roller 20*c* is pressed by the feeding roller 10*c* at a predetermined nip pressure. This nip pressure forms a nip portion N between the press-contact roller 11*c* and the contact member 22*c*.

Further, in the configuration described above, the feeding roller 10*c* corresponds to the feeding roller according to the present invention, and the retard roller 20*c* corresponds to the retard roller according to the present invention. The feeding roller 10*c* and the retard roller 20*c* constitute the sheet-feeding mechanism according to the present invention. Further, the press-contact rollers 11*c* correspond to the press-contact roller according to the present invention. Further, the contact member 22*c* corresponds to the press-contact portion according to the present invention, and the projecting portion 23*c* corresponds to the projecting portion according to the present invention.

Figure 11:
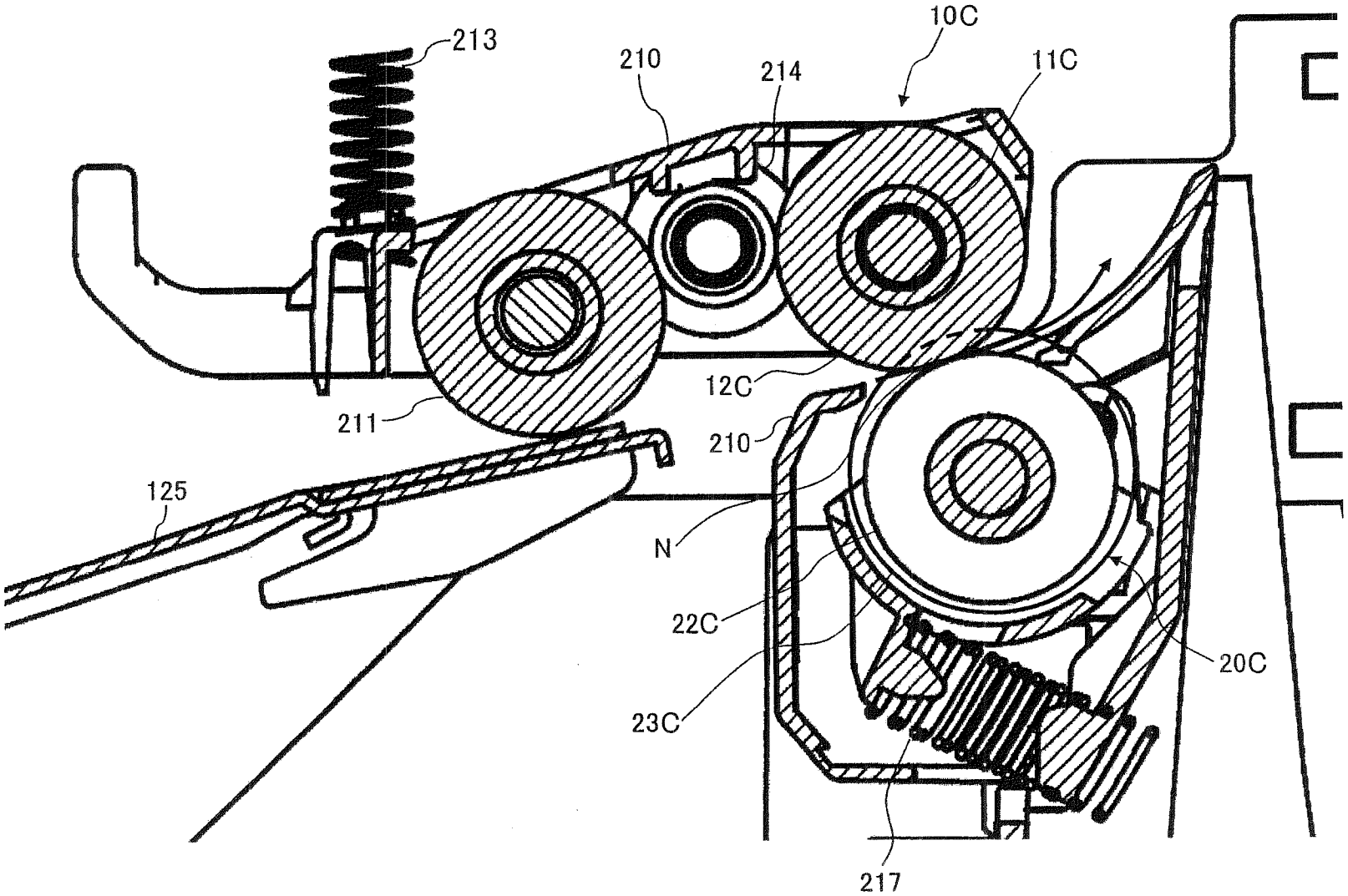
FIG. 11 is a sectional view showing configurations of relevant parts of the sheet-feeding device 120 including the sheet-feeding mechanism in accordance with the third embodiment of the present invention.

A basic operation of the sheet-feeding mechanism 1 in accordance with the embodiment of the present invention having such configuration as described above is similar to the operation of the conventional sheet-feeding mechanism. Referring to FIG. 11, if the pick-up roller 211 in contact with the sheet held on the tray 125 follows the rotations of the feeding roller 10*c* to send out the sheet, the sheet is guided along the cover 216 to the nip portion N formed between the feeding roller 10*c* and the retard roller 20*c*.

If only one sheet is sent to the feeding roller 10*c*, a force in opposite directions is applied to the sheet by the feeding roller 10*c* and the retard roller 20*c*. However, transmission of a rotational torque with respect to the retard roller 20*c* is shut down by a load greater than a predetermined amount applied to the torque limiter. Accordingly, the retard roller 20*c* is rotated in a direction of following the rotation of the feeding roller 10*c* (the retard roller 20*c* rotates in a clockwise direction: FIG. 11), so that the sheet is conveyed to outside of the sheet-feeding device.

On the other hand, when two or more sheets are guided to a clearance defined between the feeding roller 10*c* and the retard roller 20*c* in a stacked state, the uppermost sheet comes in contact with the surface of the feeding roller 10*c* rotating in the conveying direction and then is sent to inside. On the other hand, rotation of the retard roller 20*c* in the opposite direction with respect to the sheet-conveying direction (the retard roller 20*c* rotates in the counter-clockwise direction in FIG. 11) causes the sheet on the lower side to be pushed back in the opposite direction with respect to the sheet-conveying direction indicated by the arrow in the drawing.

According to the basic operation described above, the sheet-feeding mechanism 1 in accordance with the third embodiment of the present invention has a configuration in which, as shown in FIGS. 10A-10C, the feeding roller 10*c* including the plurality of press-contact rollers 11*c* and the retard roller 20*c* provided with the projecting portion 23*c* are used. Therefore, the following effect can be achieved.

Figure 12:
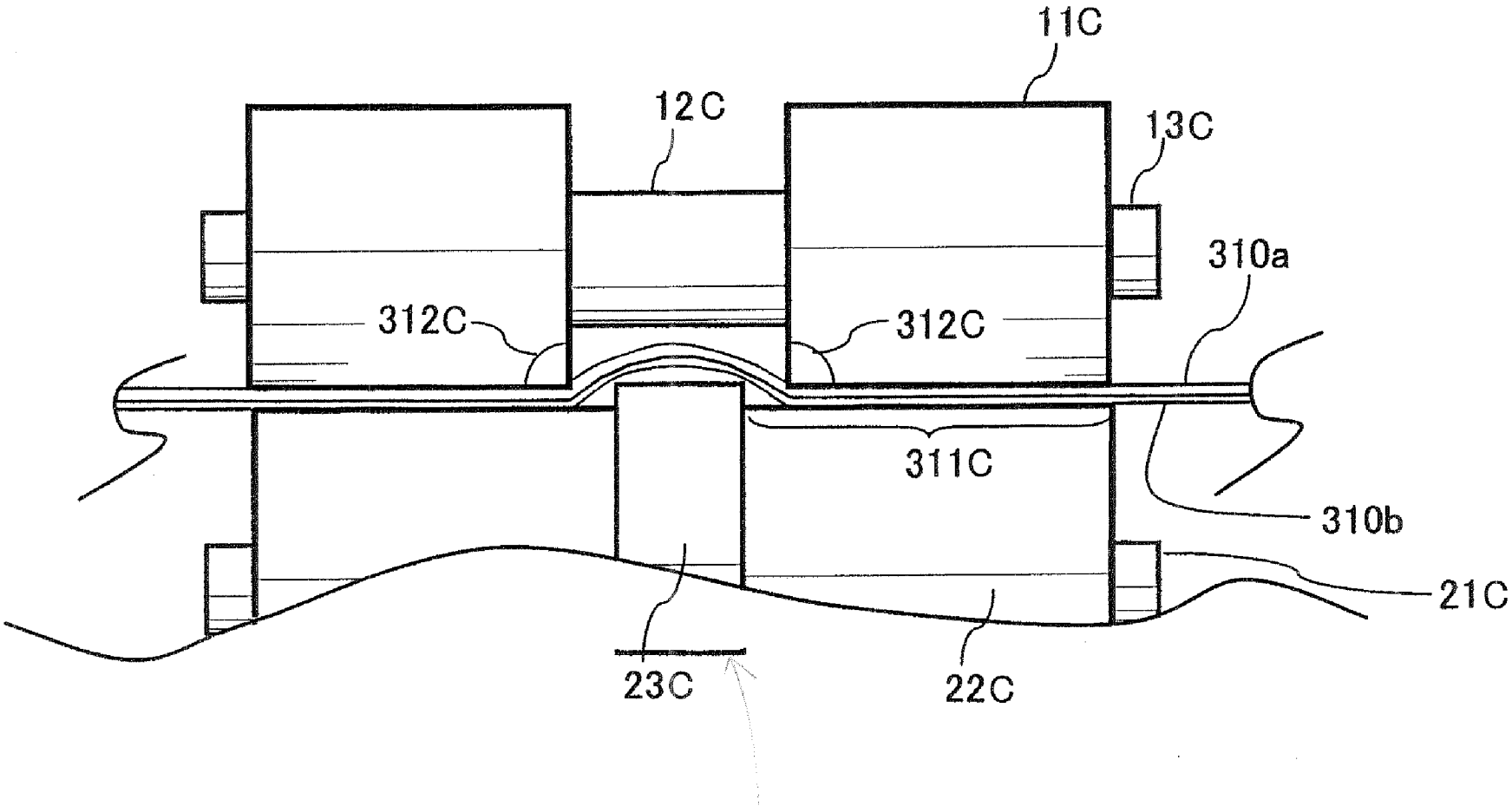
FIG. 12 shows the effect of the sheet-feeding mechanism in accordance with the third embodiment of the present invention.

FIG. 12 shows a state where two sheets 310*a* and 310*b* are inserted between the feeding roller 10*c* and the retard roller 20*c* at the same time in the sheet-feeding mechanism 1 in accordance with the third embodiment. As shown in FIG. 12, the elastic member 217 shown in FIG. 11 exerts a biasing force to cause the contact member 22*c* of the retard roller 20 to come in contact with the press-contact rollers 11*c* of the feeding roller 10*c* and deform the press-contact rollers 11*c*, so that a pair of press-contact surfaces 311*c* which becomes the nip portion are formed.

Further, into the area defined between the press-contact rollers 11*c* adjacent to each other, an outer peripheral portion of the projecting portion 23*c* projects, so that a main surface is formed which comes close to the feeding roller 10*c* more than the press-contact surfaces 311*c* do.

The press-contact surfaces 311*c* as nip portions formed by the pair of press-contact rollers 11*c* and the contact member 22*c* comes in press-contact with the sheets 310*a* and 310*b* guided between the feeding roller 10*c* and retard roller 20*c*. On the other hand, since the sheets 310*a* and 310*b* are pushed toward the feeding roller 10*c* along the shape of the main surface of the projecting portion 23*c*, a cross-sectional shape of the sheet viewed from the conveying direction is deformed to be a wave-like shape. At this time, the sheet 310*b* which comes in contact with the retard roller 20*c* is deformed along the projecting portion 23*c* and fitted between the press-contact rollers 11*c*. Accordingly, a retaining force applied by the retard roller 20*c* improves. On the other hand, the sheet 310*a* which comes in contact with the feeding roller 10*c* is pressed against the press-contact surfaces 311*c* including edge portions 312*c* of the press-contact rollers 11*c*. Accordingly, a contact with respect to the surface of the contact member 22*c* becomes stronger.

Thus, the sheet in contact with the feeding roller 10*c* and the sheet in contact with the retard roller 20*c* are strongly retained by respective rollers, so that the effect of improving separability can be achieved.

If three or more sheets are guided in stack, it is considered that separability may be improved on the following reasons.

Figure 13:
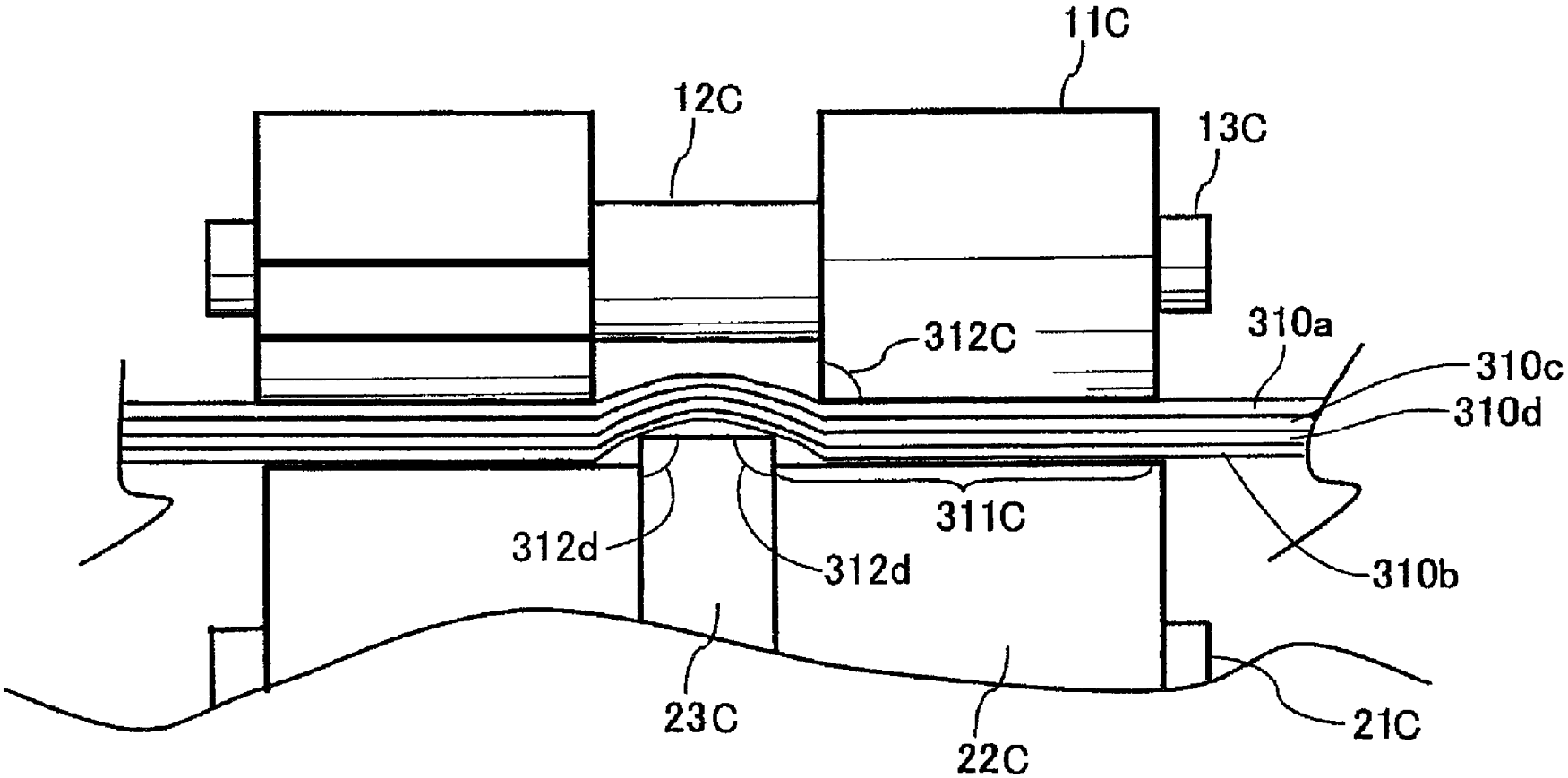
FIG. 13 shows the effect of the sheet-feeding mechanism in accordance with the third embodiment of the present invention.

FIG. 13 shows a state where four sheets 310*a*-310*d* are inserted between the feeding roller 10*c* and the retard roller 20*c* at the same time. The sheet 310*a* is in contact with the feeding roller 10*c* directly, and the sheet 310*b* is in contact with the contact member 22*c* directly, and the sheets 310*c* and 310*d* are layered between the sheets 310*a* and 310*b*.

In the configuration of the present embodiment, the projecting portion 23*c* and the pair of press-contact rollers 11*c* cause the stacked sheets 310*a*-310*d* to come in press-contact with each other. Accordingly, a cross-sectional shape of the sheets viewed from the sheet-conveying direction is deformed to be a wave-like shape along the shape formed by the projecting portion 23*c* and the edge portions 312*c* of the press-contact rollers 11*c*. At this time, it is considered that the sheets 310*a*-310*d* are banded and integrated by pressure from the rollers and deformation into a wave-like shape.

The banded sheets 310*a*-310*d* receive from the feeding roller 10*c* and the retard roller 20*c* a force in opposite directions. The sheets 310*b*-310*d*, which are other than the sheet 310*a* in close contact with the press-contact rollers 11*c* of the feeding roller 10*c*, are separated from the sheet 310*a* and put back to the tray 126 while retaining the state of being banded by the deformation, similarly to the case of the sheet 301*b* shown in FIG. 18.

In other words, as shown in FIG. 13, if the sheets are conveyed in a layered state, the sheets are pressed against the left and right edge portions 312*c* of the press-contact rollers 11*c* and the projecting portion 23*c* of the retard roller 22*c* to be deformed into a wave-like shape. At this time, deformation of the sheet in the lowermost layer becomes acuter at the edge portions 312*d* of the projecting portion 23*c*, and deformation of the sheet in the upper layer becomes looser. As described above, acute deformation of the sheets in the lower layers causes stress to be intensive at the deformed portion of the sheet. The stress serves as a pressure to the sheets in the lower layers, and the sheets in the lower layers are likely to be banded and integrated. In this case, comparing a frictional force (1) exerted between the uppermost sheet 310*a* and the feeding roller 10 with a retaining force (2) due to a frictional force exerted between the sheet 310*a* and the sheet 310*c* just under the same, if normal copying sheets are used, the frictional force (1) wins over the retaining force (2). Thus, the sheet 310*a* in the uppermost layer is conveyed along the rotation of the feeding roller 10*c*, and other lower sheets 310*b*-310*d* band together and moves back following a counter-clockwise rotation (FIG. 2) of the retard roller 20*c*.

As described above, in the present embodiment, the sheets 310*b*-310*d* which should follow the rotation of the retard roller 20*c* are more likely to be integrally retained with respect to the sheet 310*a* which should follow the rotation of the feeding roller 10*c*. Therefore, even when three or more sheets, while in a stacked state, are guided to a position between the rollers, favorable separability can be secured.

In the description above with reference to FIG. 10A and the like, the projecting portion 23*c* forms a step projecting beyond the contact member 22*c* by about 1 mm. However, there is a case where the press-contact surface 311*c* is deformed by the press-contact with respect to the press-contact rollers 11*c* so that the surface of the contact member 22*c* is recessed. In this case, since the distance between the surface of the projecting portion 23*c* and the surface of the contact member 22*c* becomes wider, the step formed by the projecting portion 23*c* may be so set as to be smaller than 1 mm. In other words, as long as the projecting portion 23*c* can deform the sheet to have a suitable wave-like shape, it is not limited to a particular size.

Figure 14:
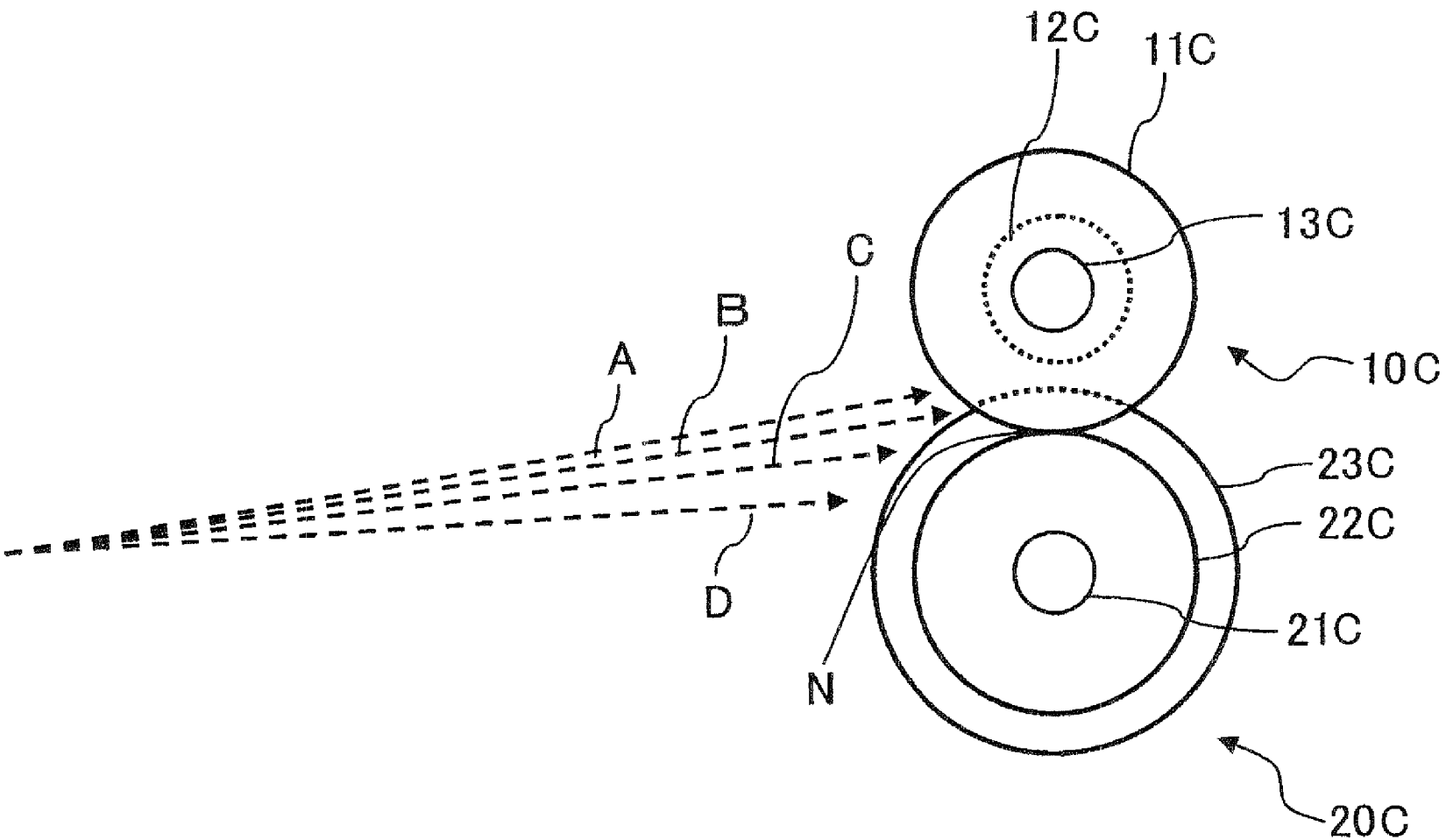
FIG. 14 shows the effect of the sheet-feeding mechanism in accordance with the third embodiment of the present invention.
Figure 22B:
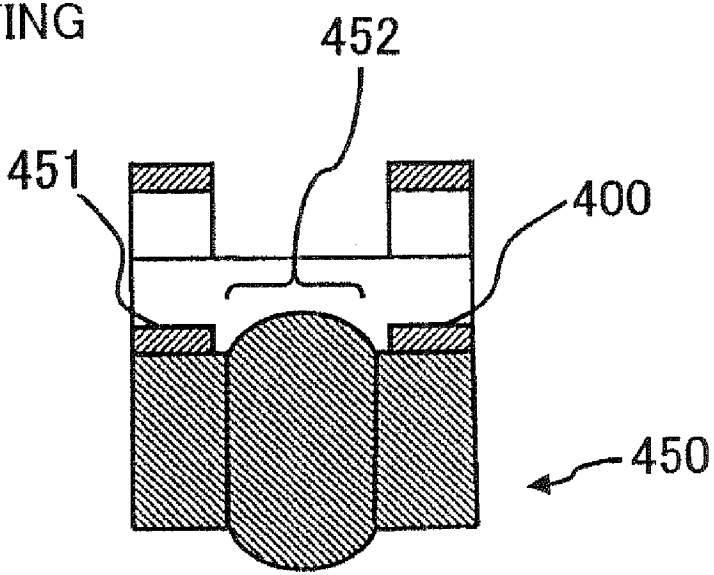
FIG. 22B is a sectional view taken along the line A-A of FIG. 22A.
Figure 22A:
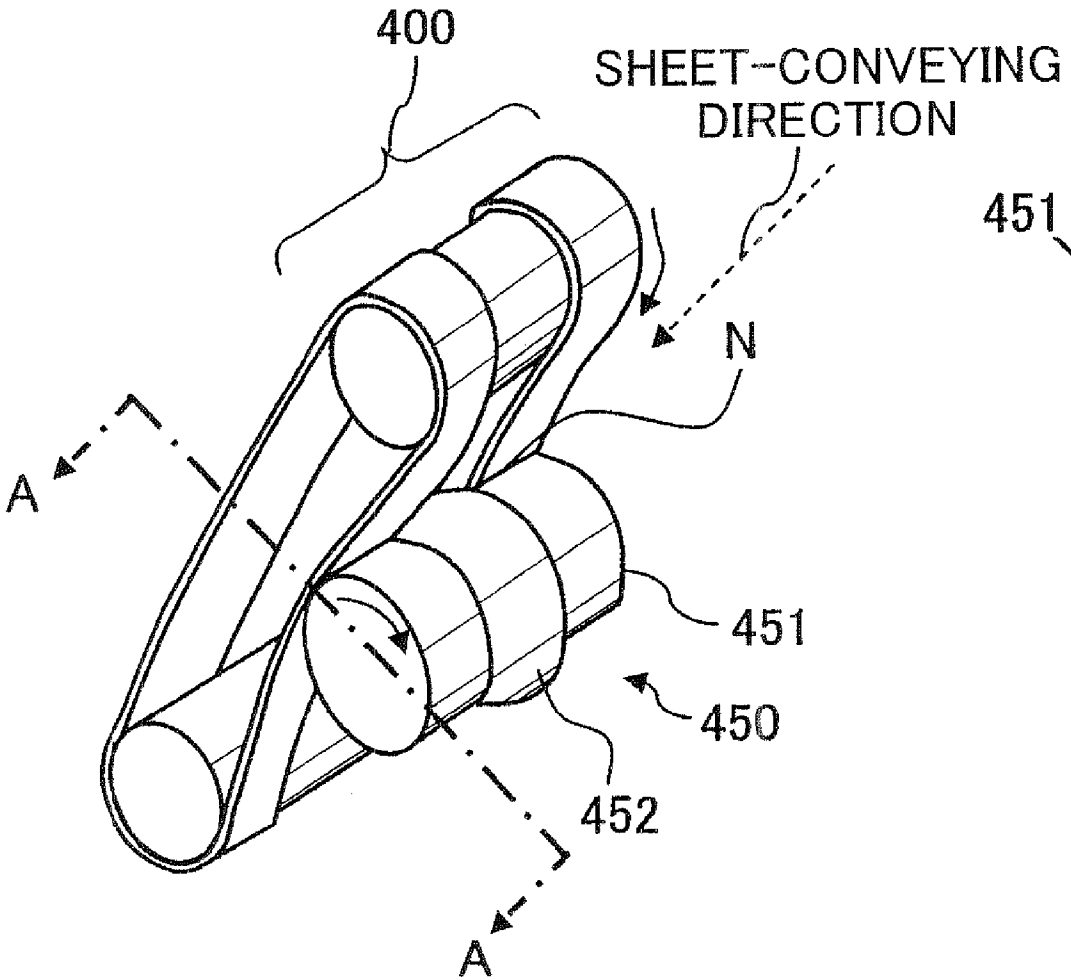
FIG. 22A is a perspective view showing a configuration of a sheet-feeding mechanism according to a conventional technology.
Figure 23:
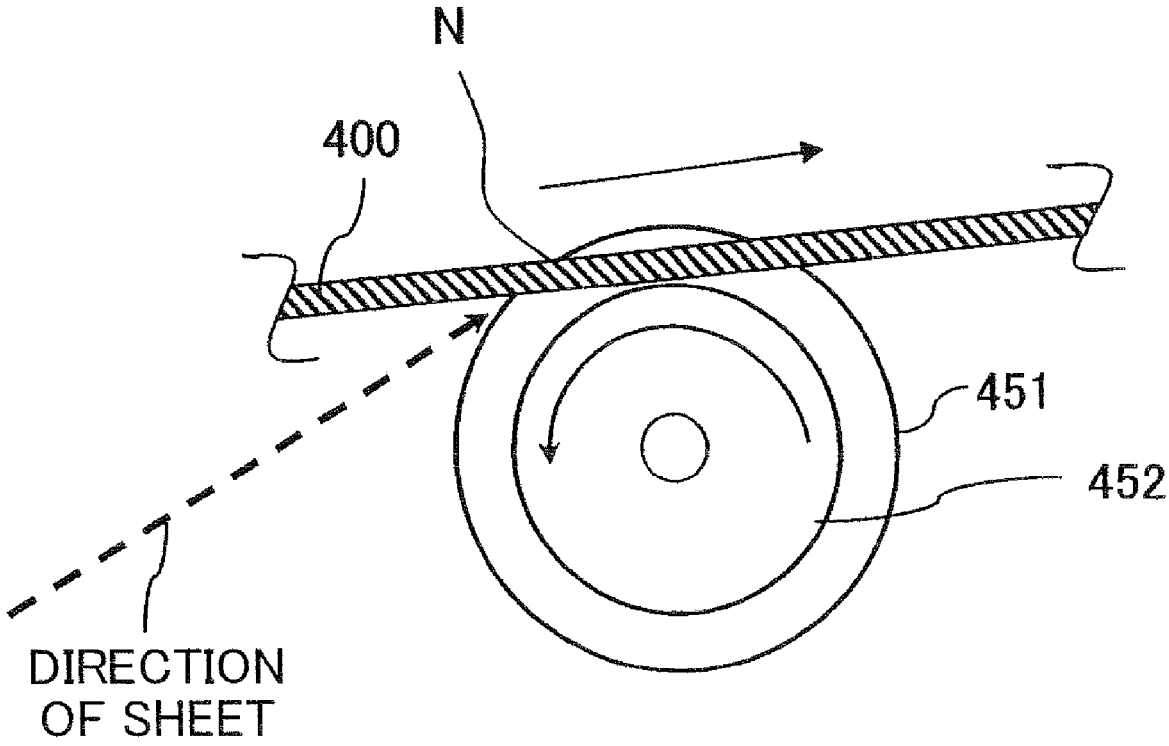
FIG. 23 shows a state where the sheet is conveyed in the sheet-feeding mechanism according to the conventional technology.
Figure 24:
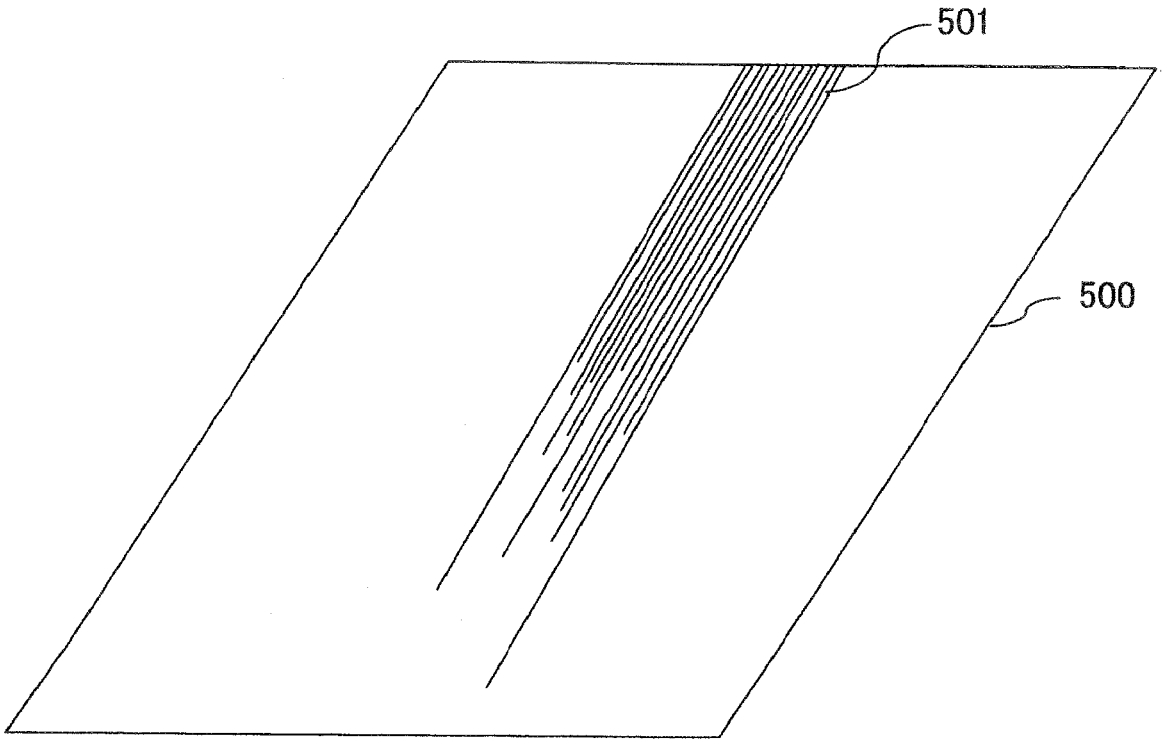
FIG. 24 shows a problem present in the sheet-feeding mechanism according to the conventional technology.

Next, FIG. 14 shows another effect of the sheet-feeding mechanism 1 in accordance with the present embodiment. As already shown in FIG. 10C, the projecting portion 23*c* of the retard roller 20*c* has a larger outer diameter as compared to the press-contact rollers 11*c* of the feeding roller 10*c* and projects more on a front side than the feeding roller 10*c* with respect to the sheet-conveying directions A-D indicated by broken lines in the drawing. Accordingly, it becomes more likely that the sheets to be conveyed collide with the retard roller 20*c*. This is the problem similar to the one pointed out in the conventional examples shown in FIGS. 22A and 22B.

However, the projecting portion 23*c* of the retard roller 20*c* in accordance with the present embodiment is made of POM material having more excellent smoothness as compared to the press-contact rollers 11*c* or the like, and surface machining such as irregularity is not applied unlike the technology disclosed in the patent document 1. Thus, even if the end portion of the sheet comes in contact at the angle of the conveying direction C, the sheet is conveyed around the surface of the projecting portion 23*c* and guided along the outer side of the rotating retard roller to the nip portion N.

Further, since the surface of the projecting portion 23*c* is smooth, even in a state where the sheet is fitted between the feeding roller 10*c* and the retard roller 20*c*, a contact with the projecting portion 23*c* makes it possible to reduce a possibility of causing a damage on the surface of the sheet.

As described above, according to the sheet-feeding mechanism of the present embodiment, separability can be improved while preventing damage on the sheet due to collision with the retard roller 20*c*.

Figure 15A:
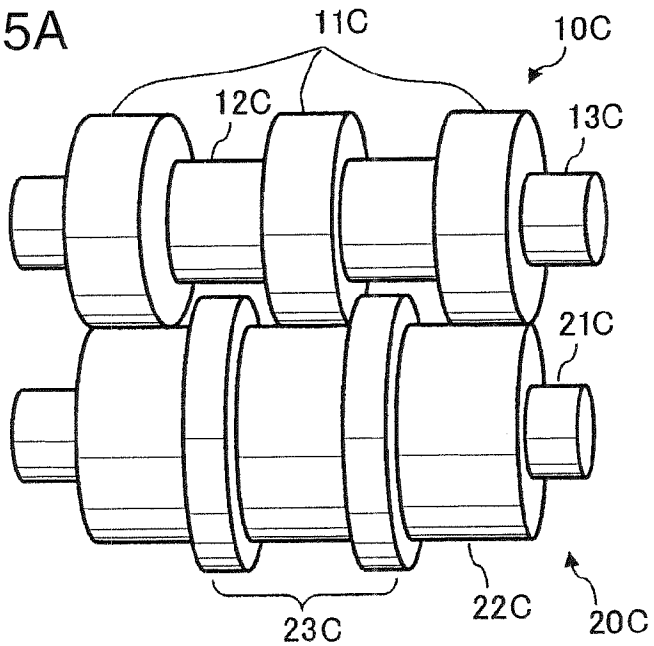
FIG. 15A is a perspective view showing another configuration of the sheet-feeding mechanism in accordance with the third embodiment of the present invention.

In the description above, the pair of press-contact rollers 11*c* as the feeding roller 10*c* are arranged symmetrically, and the projecting portion 23*c* of the retard roller 20*c* is provided therebetween. However, a configuration of the press-contact roller and the projecting portion in accordance with the present invention is not limited to the example shown in FIG. 10 or the like. FIG. 15A shows a configuration in which three press-contact rollers 11*c* and three projecting portions 23*c* are provided. In summary, in the present embodiment, it is sufficient a configuration in which a projecting portion of the retard roller is arranged between the press-contact rollers of the feeding roller, and the configuration is not limited by the size, the number, and the arrangement.

Figure 15B:
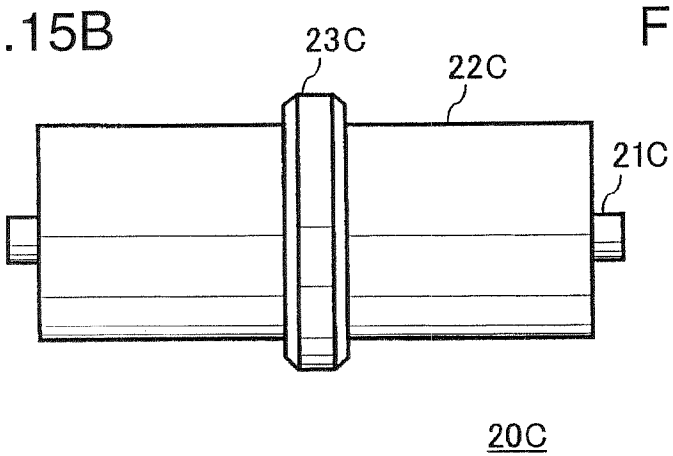
FIG. 15B shows another configuration of a projecting portion 23*c* of a retard roller 20.
Figure 15C:
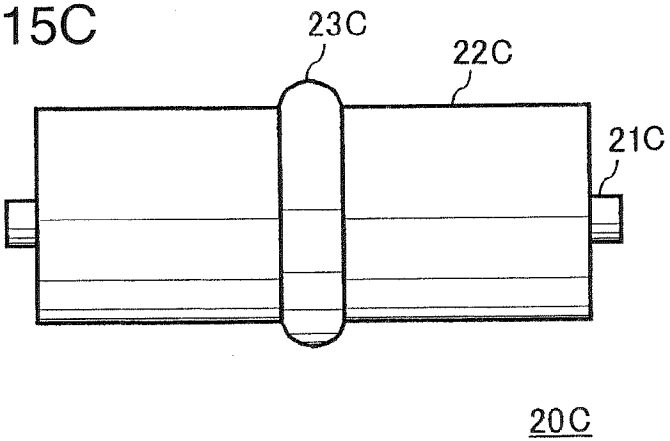
FIG. 15C shows yet another configuration of the projecting portion 23*c* of the retard roller 20.

Further, in the description above, the projecting portion 23*c* of the retard roller 20*c* is formed coaxially with the contact member 22*c* and having a cylindrical shape. However, the projecting portion 23 may have a configuration in which the edge portions to come in contact with the surface of the sheet is taken off as shown in FIG. 15B or so formed as to have a curved surface as shown in FIG. 15C. In summary, the projecting portion in accordance with the present embodiment is not limited to particular shape as long as arranging the projecting portion between the press-contact rollers of the roller facing the same deforms the sheet sandwiched therebetween to have a wave-like shape. Especially, in the case of the configuration shown in FIGS. 15B and 15C, a possibility of damaging the sheet surface can be further reduced by forming the contact part with respect to the sheet surface to be smooth.

Further, in the description above, the feeding roller 10*c* includes the plurality of press-contact rollers 11*c*, and the projection 23*c* is provided on the retard roller 20*c*. However, according to the present invention, the retard roller may include a plurality of press-contact rollers, and the projecting portion may be provided on the feeding roller.

Figure 16A:
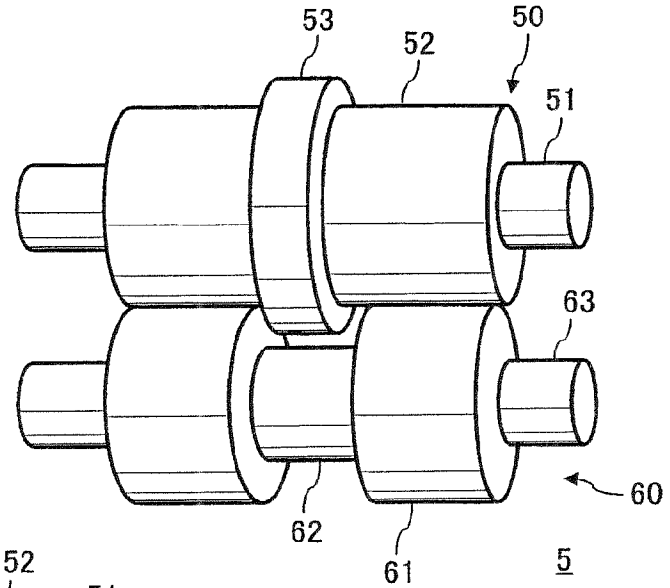
FIG. 16A is a perspective view schematically showing relevant parts of yet another configuration of the sheet-feeding mechanism in accordance with the third embodiment of the present invention.
Figure 16B:
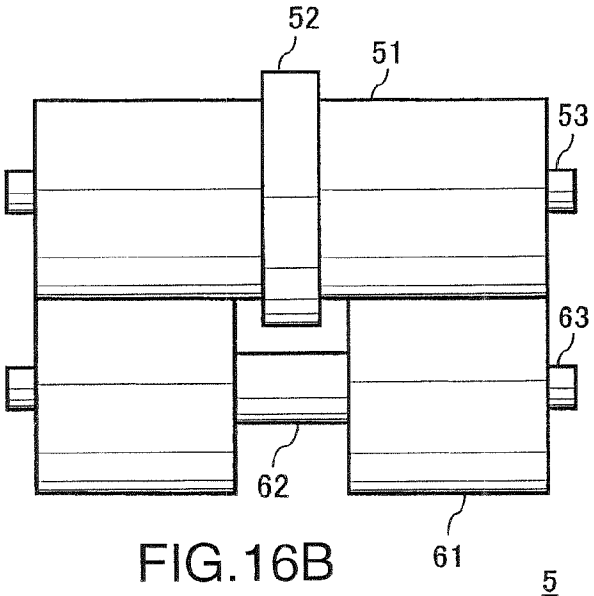
FIG. 16B is a front view schematically showing the relevant parts.
Figure 16C:
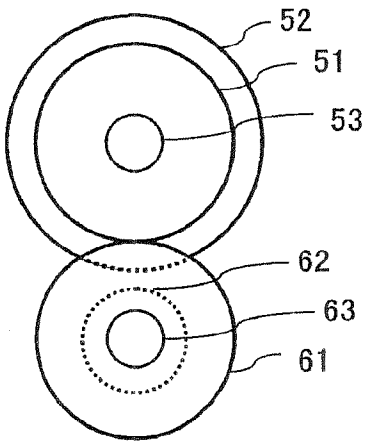
FIG. 16C is a side view schematically showing the relevant parts.

FIGS. 16A, 16B, and 16C are a perspective view, a front view, and a side view schematically showing relevant parts of the sheet-feeding mechanism in accordance with yet another configuration of the third embodiment.

In FIGS. 16A-16C, the feeding roller 50 constituting the sheet-feeding mechanism 5 includes a rotational shaft 51 to which a rotational drive force is transmitted from outside, a contact member 52 provided around the rotational shaft 51 to come in contact with the sheet, and the projecting portion 53 provided in an outer periphery of the contact member 52. Further, the retard roller 60 constituting the sheet-feeding mechanism 5 includes a pair of press-contact rollers 61 which come in contact with the surface of the contact member 52 of the feeding roller 50, a connecting shaft 62 for connecting the press-contact rollers 61, and a rotational shaft 63 provided coaxially with the connecting shaft 62.

The configuration above corresponds to a configuration in which configurations of the feeding roller 10*c* and the retard rollers 20*c* shown in FIG. 10A-10C are switched. The projecting portion 53 is made of the POM material similar to the projecting portion 23*c* of FIG. 10, so that its surface has a higher smoothness as compared to the surfaces of the contact member 52 and the press-contact rollers 61.

Especially in this configuration, as shown in FIG. 16C, a diameter of the feeding roller 50 is larger by the length of the projecting portion 53, so that it becomes more likely that the sheet guided by the pick-up roller 211 collides with the projecting portion 53. However, since the surface of the projecting portion 53 has a high smoothness, the end portion or surface of the sheet is not damaged. Further, since the smoothness of the surface of the projecting portion 53 is made high so that the feeding roller 50 does not take up the sheet to the nip portion with a force greater than needed, multi-feeding can be prevented.

Further, in the configuration above, the press-contact rollers 11*c* of the feeding roller 10*c* and the contact member 22*c* of the retard roller 20*c* are made of the same kind of material (rubber). However, it may be the different kinds of material.

Further, the projecting portions 23*c* and 53 are made of POM material. However, as long as the smoothness is higher than the surfaces of the contact member 22*c* and the press-contact roller 11*c*, materials such as polyethylene (PE), polycarbonate (PC), polypropylene (PP), nylon 6, and ABS, or metal material such as stainless steel (SUS) may be used, and it is not limited by particular composition.

Further, in each of the embodiments above, the sheet-feeding mechanism 1 is mainly described. However, the present invention may be realized as a sheet-feeding device provided with the sheet-feeding mechanism in accordance with the present invention. At this time, the pick-up roller 211 corresponds to the pick-up roller of the present invention, and the tray 125 corresponds to the tray according to the present invention, and other structures such as the bottom surface 126, the cover 216, and the like correspond to the housing according to the present invention.

Further, in the image forming apparatus shown in FIG. 17, an image forming apparatus provided with a sheet-feeding device as the sheet-feeding device according to the present invention is also included in the present invention. At this time, the image forming section corresponds to the image forming section in accordance with the present invention, and the image fixing section 140 corresponds to the image fixing section according to the present invention.

The present invention achieves an effect of improving separability of sheets from one another without damaging the sheet, and it is useful in the sheet-feeding mechanism, and the sheet-feeding device and the image forming apparatus provided with the sheet-feeding mechanism.

The following is a summary of the aforementioned description:

A-1:

The sheet-feeding mechanism in accordance with the first and second embodiments of the present invention includes: a feeding roller which rotates in a sheet-conveying direction, at least a surface of the feeding roller being flexible; and a retard roller having a plurality of press-contact rollers which come in press-contact with the feeding roller at a predetermined pressure to form a plurality of press-contact surface, and a hardness of the feeding roller and a hardness of the retard roller are different from one another.

According to the configuration described above, a sheet-feeding mechanism capable of improving separability with respect to other sheets without damaging the sheet, and a sheet-feeding device and an image forming apparatus provided with the sheet-feeding mechanism can be provided.

A-2:

It is preferable that a portion of the feeding roller corresponding to an axial clearance between the first press-contact roller and the second press-contact roller, which are adjacent to each other, is so deformed as to bulge toward an axis of the retard roller due to a difference in the hardness between the feeding roller and the press-contact roller.

A-3:

It is preferable that a hardness of the feeding roller is smaller than a hardness of the retard roller.

A-4:

It is preferable that the axial clearance faces an axially mid portion of the feeding roller.

A-5:

It is preferable that the sheet-feeding mechanism further includes: a guide member which is so provided as to extend from the sheet-conveying side toward the axial clearance, the guide member being adapted for guiding a sheet to the press-contact surface.

A-6:

A cover portion may be further provided on the sheet-conveying side of the retard roller, and the guide member can be provided as a separate member to the cover portion.

A-7:

A cover portion may be further provided on the sheet-conveying side of the retard roller, and the guide member can be formed integrally with the cover portion.

A-8:

It is preferable that an outer diameter of the feeding roller is substantially equal to an outer diameter of the press-contact roller of the retard roller.

A-9:

It is preferable that the feeding roller is supported by a first shaft, and the retard roller is supported by a second shaft, and when the plurality of press-contact rollers and the feeding roller are in contact with each other, a space is defined between the first shaft and the second shaft in a view from the sheet conveying direction, and the guide member extends into the space.

A-10:

Further, it is preferable that the sheet-feeding mechanism further includes: a first elastic member for urging the feeding roller toward the retard roller; and a second elastic member for urging the retard roller toward the feeding roller, and a sum of biasing force applied by the first elastic member and the second elastic member to cause the feeding roller and the retard roller to come in press-contact with each other is so set as to cause an axially mid portion of the first shaft of the feeding roller to bulge toward the second shaft more greatly than the contact portion with respect to the retard roller.

A-11

Further, the present invention includes a sheet-feeding device including: a housing; a tray for holding sheets; a sheet-feeding mechanism defined in any of the items A1-A10 defined above; and a pick-up roller for conveying sheets held on the tray to the sheet-feeding mechanism.

A-12

Further, the present invention includes an image forming apparatus including: the sheet-feeding device according to the present invention defined in the item A11 above; an image forming section for forming an image onto a sheet conveyed from the sheet-feeding mechanism of the sheet-feeding device; and an image fixing section for fixing the image formed on the sheet.

B-1

The sheet-feeding mechanism in accordance with the third embodiment of the present invention includes: a feeding roller which rotates in a sheet-conveying direction; and a retard roller which domes in press-contact with the feeding roller at a predetermined pressure, and any one of the feeding roller and the retard roller has a plurality of press-contact rollers which are arranged along on a common rotational axis at a predetermined interval, and the feeding roller or the retard roller having no press-contact roller includes a press-contact portion which comes in press-contact with the plurality of press-contact rollers directly and a projecting portion having a diameter larger than that of the press-contact portion and positioned between the plurality of press-contact rollers, and a surface of the projecting portion has a smoothness which is higher than that of the surface of the press-contact portion.

B-2:

Further, in the configuration above, the feeding roller may include the plurality of press-contact rollers, and the retard roller may be provided with the press-contact portion and the projecting portion.

B-3

Further, in the configuration of the item B-2, the feeding roller may include the pair of press-contact rollers, and the projecting portion of the retard roller may be positioned at an axial mid portion of the retard roller.

B-4:

Further, in the sheet-feeding mechanism mentioned in the item B-1, the retard roller may include the plurality of press-contact rollers, and the feeding roller may include the pressed contact portion and the projecting portion.

B-5

A sheet-feeding device can be provided which includes: a housing; a tray for holding sheets; the sheet-feeding mechanism (third embodiment) of the present invention mentioned in any of the items B1-B4; and a pickup roller for conveying sheets held on the tray to the sheet-feeding mechanism.

B-6

Further, an image forming apparatus can be provided which includes: the sheet-feeding device defined in the item B5; an image forming section for forming an image onto a sheet conveyed from the sheet-feeding mechanism of the sheet-feeding device; and an image fixing section for fixing the image formed on the sheet.

According to the configuration described above, a sheet-feeding mechanism capable of improving separability with respect to other sheets without damaging the sheet, and a sheet-feeding device and an image forming apparatus provided with the sheet-feeding mechanism.

The present invention achieves an effect of improving separability of sheets from one another without damaging the sheet, and it is useful in the sheet-feeding mechanism, and the sheet-feeding device and the image forming apparatus provided with the sheet-feeding mechanism.

This application is based on Japanese Patent Application Serial No. 2007-183367 and Serial No. 2007-183548 filed in Japan Patent Office both on Jul. 12, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet-feeding mechanism, comprising:

a feeding roller which rotates in a sheet-conveying direction, at least a surface of the feeding roller being flexible; and a retard roller having a plurality of press-contact rollers, which are arranged on a common axis and come in press-contact with the feeding roller at a predetermined pressure so as to form a plurality of press-contact surfaces, and being rotatable in an opposite direction with respect to the sheet-conveying direction, the plurality of press-contact rollers having a first press-contact roller and a second press-contact roller which are adjacent to each other in an axial direction, wherein a hardness of the feeding roller being smaller than a hardness of the retard roller, and a portion of the feeding roller corresponding to an axial clearance between the first press-contact roller and the second press-contact roller is deformed to bulge toward an axis of the retard roller due to a difference in the hardness between the feeding roller and the press-contact rollers.

2. The sheet-feeding mechanism according to claim 1, wherein the axial clearance faces an axially mid portion of the feeding roller.

3. The sheet-feeding mechanism according to claim 1, wherein an outer diameter of the feeding roller is substantially equal to an outer diameter of the press-contact roller of the retard roller.

4. The sheet-feeding mechanism according to claim 1, further comprising: a guide member which is so provided as to extend from the sheet-conveying side toward the axial clearance, the guide member being adapted for guiding a sheet to the press-contact surface.

5. The sheet-feeding mechanism according to claim 4, further comprising: a cover portion provided on the sheet-conveying side of the retard roller, wherein the guide member is provided as a separate member to the cover portion.

6. The sheet-feeding mechanism according to claim 4, further comprising: a cover portion provided on the sheet-conveying side of the retard roller, wherein the guide member is formed integrally with the cover portion.

7. The sheet-feeding mechanism according to claim 4, wherein the feeding roller is supported by a first shaft, and the retard roller is supported by a second shaft, and when the plurality of press-contact rollers and the feeding roller are in contact with each other, a space is defined between the first shaft and the second shaft in a view from the sheet conveying direction, and the guide member extends into the space.

8. The sheet-feeding mechanism according to claim 7, further comprising:

a first elastic member for urging the feeding roller toward the retard roller; and a second elastic member for urging the retard roller toward the feeding roller, wherein a sum of biasing force applied by the first elastic member and the second elastic member to cause the feeding roller and the retard roller to come in press-contact with each other is so set as to cause an axially mid portion in an axial direction of the first shaft of the feeding roller to bulge toward the second shaft more greatly than the contact portion with respect to the retard roller.

9. A sheet-feeding device, comprising:

a) a housing;

b) a tray for holding sheets;

c) a sheet-feeding mechanism, including:

c1) a feeding roller which rotates in a sheet-conveying direction, at least a surface of the feeding roller being flexible; and c2) a retard roller having a plurality of press-contact rollers, which are arranged on a common axis and come in press-contact with the feeding roller at a predetermined pressure so as to form a plurality of press-contact surfaces, and being rotatable in an opposite direction with respect to the sheet-conveying direction, the plurality of press-contact rollers having a first press-contact roller and a second press-contact roller which are adjacent to each other in an axial direction, and c3) a hardness of the feeding roller being smaller than a hardness of the retard roller; and d) a pick-up roller for conveying sheets held on the tray to the sheet-feeding mechanism, wherein a portion of the feeding roller corresponding to an axial clearance between the first press-contact roller and the second press-contact roller is so deformed to bulge toward an axis of the retard roller due to a difference in the hardness between the feeding roller and the press-contact roller.

10. An image forming apparatus, comprising:

(A) sheet-feeding device including:

a) a housing;

b) a tray for holding sheets;

c) a sheet-feeding mechanism, including:

c1) a feeding roller which rotates in a sheet-conveying direction, at least a surface of the feeding roller being flexible; and c2) a retard roller having a plurality of press-contact rollers, which are arranged on a common axis and come in press-contact with the feeding roller at a predetermined pressure so as to form a plurality of press-contact surfaces, and being rotatable in an opposite direction with respect to the sheet-conveying direction, the plurality of press-contact rollers having a first press-contact roller and a second press-contact roller which are adjacent to each other in an axial direction, and c3) a hardness of the feeding roller being smaller than a hardness of the retard roller; and d) a pick-up roller for conveying sheets held on the tray to the sheet-feeding mechanism; and (B) an image forming section for forming an image onto a sheet conveyed from the sheet-feeding mechanism of the sheet-feeding device; and (C) an image fixing section for fixing the image formed on the sheet, and a portion of the feeding roller corresponding to an axial clearance between the first press-contact roller and the second press-contact roller is deformed to bulge toward an axis of the retard roller due to a difference in the hardness between the feeding roller and the press-contact rollers.

* * * * *